US007881627B2

(12) United States Patent
Hano et al.

(10) Patent No.: US 7,881,627 B2
(45) Date of Patent: Feb. 1, 2011

(54) IMAGE FORMING APPARATUS

(75) Inventors: Masami Hano, Abiko (JP); Fumiteru Gomi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 383 days.

(21) Appl. No.: 12/025,973

(22) Filed: Feb. 5, 2008

(65) Prior Publication Data

US 2008/0187334 A1 Aug. 7, 2008

(30) Foreign Application Priority Data

Feb. 6, 2007 (JP) ..... 2007-027412

(51) Int. Cl.
*G03G 15/00* (2006.01)

(52) U.S. Cl. ..... 399/48; 399/169; 399/296

(58) Field of Classification Search ..... 399/48, 399/49, 169, 235, 296, 314
See application file for complete search history.

(56) References Cited

U.S. PATENT DOCUMENTS

| | | | | |
|---|---|---|---|---|
| 5,041,877 | A * | 8/1991 | Matsumoto | 399/66 |
| 5,319,433 | A | 6/1994 | Fukushima et al. | |
| 5,481,337 | A * | 1/1996 | Tsuchiya et al. | 399/46 |
| 6,052,545 | A | 4/2000 | Komiya et al. | |
| 6,064,837 | A | 5/2000 | Hashimoto et al. | |
| 6,088,548 | A | 7/2000 | Hashimoto et al. | |
| 6,144,824 | A | 11/2000 | Hashimoto et al. | |
| 6,215,967 | B1 | 4/2001 | Takeda et al. | |
| 6,219,509 | B1 | 4/2001 | Komiya et al. | |
| 6,314,251 | B1 | 11/2001 | Gomi et al. | |
| 6,393,238 | B1 | 5/2002 | Hashimoto et al. | |
| 7,113,712 | B2 | 9/2006 | Gomi | |
| 2006/0127107 | A1 | 6/2006 | Kamisuwa et al. | |

FOREIGN PATENT DOCUMENTS

| | | | |
|---|---|---|---|
| JP | 1-234862 | A | 9/1989 |
| JP | 5-323749 | A | 12/1993 |
| JP | 6-11943 | A | 1/1994 |
| JP | 2006-171704 | A | 6/2006 |

* cited by examiner

*Primary Examiner*—David M Gray
*Assistant Examiner*—Barnabas T Fekete
(74) *Attorney, Agent, or Firm*—Fitzpatrick, Cella, Harper & Scinto

(57) ABSTRACT

An image forming apparatus includes image bearing member having a movable surface; charging means for charging the surface of the image bearing member; image exposure means for exposing the surface of the image bearing member charged by the charging means to light in accordance with image information, thus forming an electrostatic image; developing means for developing the electrostatic image formed on the image bearing member into a developed image; surface potential detecting means for detecting a potential of the surface of the image bearing member; discharging means for discharging the surface of the image bearing member; changing means for changing an image forming condition, wherein an area of the image bearing member passes the discharging means under different operating conditions of the discharging means, and the area is charged by the charging means, the changing means changes the image forming condition on the basis of a result of detection, by the surface potential detecting means, of surface potentials of the area charged by the charging means.

9 Claims, 8 Drawing Sheets

IMAGE FORMING APPARATUS

FIELD OF THE INVENTION AND RELATED ART

The present invention relates to an image forming apparatus, such as a copying machine, a laser beam printer, etc., in particular, an image forming apparatus which controls image formation conditions according to the characteristic of its image bearing member in terms of dark attenuation.

It is a common practice to employ a photosensitive member as the image bearing member of an electrophotographic image forming apparatus such as a copying machine. If a photosensitive member is left unattended after it is charged with a charging apparatus, it reduces in potential level (in the amount of electrical charge). In other words, it suffers from the so-called dark attenuation. Dark attenuation is known as a phenomenon that the surface potential of a charge photosensitive member attenuates even in a dark place, because of injected carrier and/or thermally induced carrier. It has also been known that the amount of dark attenuation increases with the elapse of time. For example, in the case of a photosensitive member which is rotated, the amount of the dark attenuation of a given point of the peripheral surface of the photosensitive member increases in proportion to the distance the given point moved from the location at which it was charged, after it was charged.

It has also been known that some image forming apparatuses employ multiple developing apparatuses which are juxtaposed in the adjacencies of their photosensitive drums. More specifically, some full-color image forming apparatuses have four developing apparatuses in which cyan, magenta, yellow, and black toners are stored one for one. As for the arrangement of the multiple developing apparatuses, there are the tandem arrangement, rotary arrangement, etc. In the case of the tandem arrangement, the multiple developing apparatuses are juxtaposed in parallel in the direction parallel to the direction in which a sheet of recording medium is moved in the main assembly of the image forming apparatus. In the case of the rotary arrangement, multiple developing apparatuses are mounted in a rotary, that is, a rotatable holder, so that they can be sequentially moved into the same development position. There are image forming apparatuses which use in combination the tandem arrangement and rotary arrangement.

In the case of some image forming apparatuses of the tandem type, their development stations are slightly different in the distance from the location at which the photosensitive member is charged, to the development location. They are also different in the distance from the charging location to the location of the sensor for detecting the amount of the electrical charge of the photosensitive member. Therefore, the multiple photosensitive members are different in the amount of the dark attenuation which occurs between the charging location and development location. Thus, the actual condition under which an electrostatic static latent image is developed in each development location becomes different from the optimal one, making it sometimes difficult to obtain a high quality image.

Even in the case of the rotary arrangement, the dark attenuation occurs between the location of the sensor for detecting the actual amount of the potential of a photosensitive member, and the development location. Therefore, the actual condition under which an electrostatic latent image is developed becomes different from the optimal one, making it sometimes difficult to obtain an image of high quality.

There have been made various proposals for dealing with the above-described problem. Generally speaking, a typical conventional method for compensating for dark attenuation is as follows: A photosensitive member is charged by a charging apparatus to a preset potential level, and the potential level of the photosensitive member is measured by a surface potential level detecting means immediately after the photosensitive member is charged. Thereafter, the photosensitive member is rotated one full turn, with the charging apparatus, and preparatory exposing apparatus kept turned off, and then, the surface potential level of the photosensitive member is detected again by the surface potential level detecting means. Then, the amount by which the surface potential of the photosensitive member attenuates between the charging location to the development location is estimated from the difference between the surface potential level immediately after the charging of the photosensitive member, and that after one full rotation of the photosensitive member. Then, the development bias, etc., are controlled based on the estimated amount of dark attenuation (Japanese Laid-open Patent Applications H05-323749, H06-11943, and 2006-171704).

However, a conventional method, such as the above-described one, for compensating for dark attenuation suffers from the following problem: The peripheral surface of a photosensitive member is in contact, or comes into contact, with various members, such as a developing means, a transferring means, a cleaning means, etc., which affect the surface potential of a photosensitive member. Thus, the surface potential level of a photosensitive member, which is measured after the photosensitive member is rotated one full turn is different from that measured before it is rotated. In other words, it is difficult to accurately measure the amount of dark attenuation with the use of a conventional method.

If the amount of dark attenuation cannot be accurately measured, the surface potential of a photosensitive member cannot be accurately controlled. Therefore, it cannot be ensured that a proper amount of fog removal potential is provided. With fog removal potential being unreliable, an image forming apparatus is likely to yield images suffering from fog.

Further, as a photosensitive member itself deteriorates in terms of chargeability due to the increase in the cumulative length of its usage, it increases in the amount of dark attenuation, which has a large amount of effect upon fog creation.

In the case of the proposal disclosed in Japanese Laid-open Patent Application H1-234862, in order to ensure that a predetermined amount of development contrast is provided even when the length of cumulative usage of the photosensitive member is substantial, the condition for charging and the condition for exposing are adjusted according to both the surface potential level $V_D$ of a photosensitive member immediately after the photosensitive member is charged by a charging means, and the residual surface potential level $V_X$ of the photosensitive member, that is, the surface potential level of the photosensitive member after the peripheral surface of the photosensitive member is exposed by a charge removal lamp to remove the electrical charge.

However, it is difficult to properly compensate for dark attenuation with the use of a method such as the one disclosed in Japanese Laid-open Patent Application H1-234862, for the following reason. That is, the dark attenuation, which occurs during a normal image forming operation, is a phenomenon that the carriers generated by a charge removing means during a preparatory exposure of a photosensitive member remain in a photosensitive member even after the completion of a charging step. As these carriers move to the peripheral surface of the photosensitive member, they reduce the surface potential of the photosensitive member through pair annihilation.

Further, the electrical resistance transfer, etc., from the carrier generation layer to the surface layer of a photosensitive member also affects the amount of dark attenuation. Therefore, it is difficult to estimate the amount of dark attenuation from the residual potential level $V_X$, that is, the surface potential level of a photosensitive member after the photosensitive member is exposed to remove electrical charge therefrom. If the amount of dark attenuation cannot be accurately measured, the surface potential of a photosensitive member cannot be accurately controlled. Therefore, it cannot be ensured that a proper amount of fog removal potential is provided. With fog removal potential being unreliable, an image forming apparatus is likely to yield images suffering from fog.

Further, there remains the possibility that as a photosensitive member itself deteriorates in terms of chargeability due to the increase in the cumulative length of its usage, it increases in the amount of dark attenuation, which has a large amount of effect upon fog creation.

SUMMARY OF THE INVENTION

Thus, the primary object of the present invention is to provide an image forming apparatus which compensates for the effects of dark attenuation of its image bearing member, being therefore capable of more precisely controlling the image formation conditions than an image forming apparatus in accordance with the prior art.

According to an aspect of the present invention, there is provided an image forming apparatus comprising an image bearing member having a movable surface; charging means for charging the surface of said image bearing member; image exposure means for exposing the surface of said image bearing member charged by said charging means to light in accordance with image information, thus forming an electrostatic image; developing means for developing the electrostatic image formed on said image bearing member into a developed image; surface potential detecting means for detecting a potential of the surface of said image bearing member; discharging means for discharging the surface of said image bearing member; changing means for changing an image forming condition, wherein an area of said image bearing member passes said discharging means under different operating conditions of said discharging means, and the area is charged by said charging means, said changing means changes the image forming condition on the basis of a result of detection, by said surface potential detecting means, of surface potentials of the area charged by said charging means.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, one of the preferred embodiments of the present invention will be described in detail with reference to the appended drawings.

Embodiment 1

General Structure of Image Forming Apparatus

Figure 1:
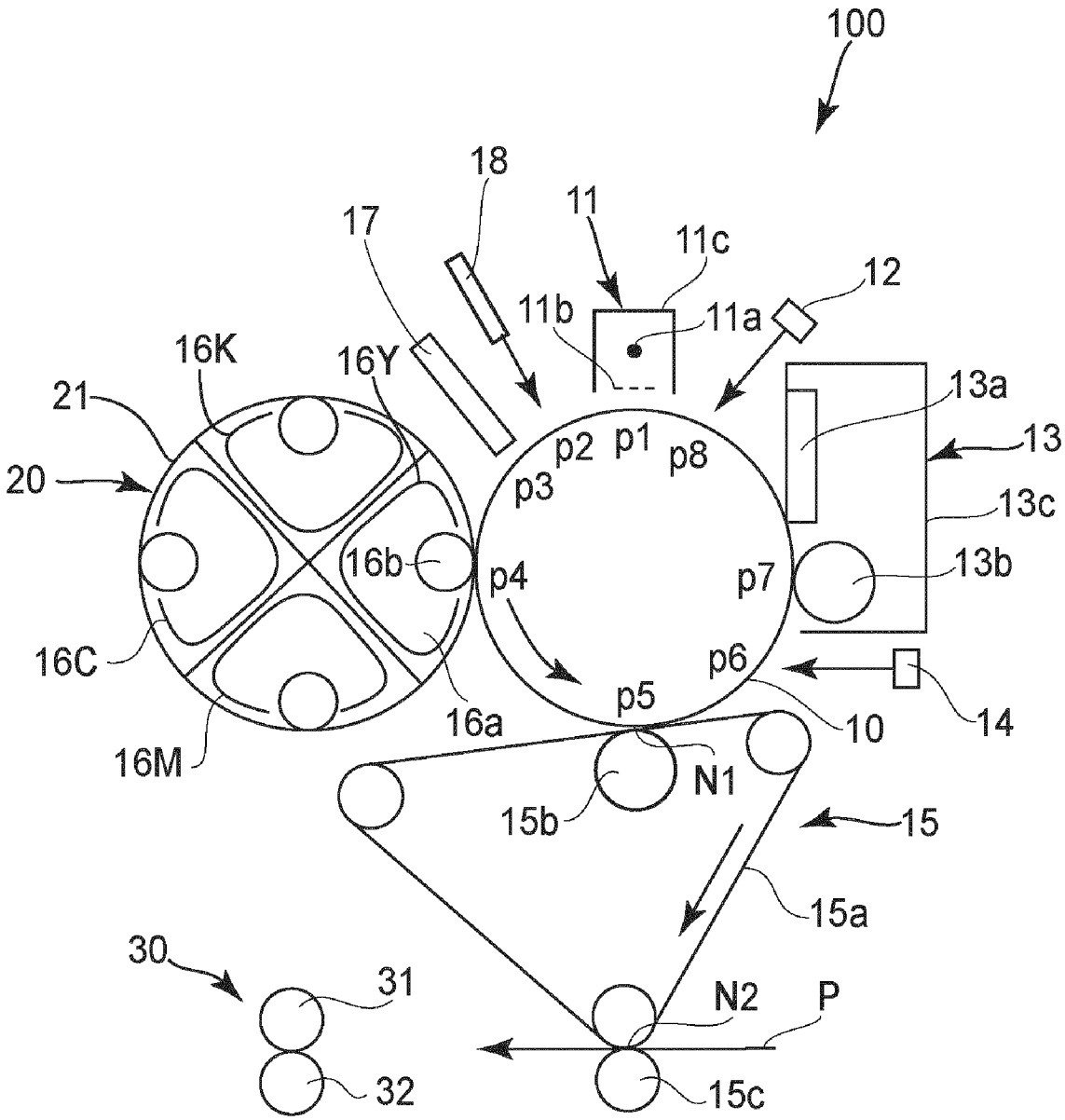
FIG. 1 is a schematic sectional view of the essential portions of the image forming apparatus in the first embodiment of the present invention, showing their general structures.

FIG. 1 shows the general structure of the image forming apparatus 100 in this embodiment. In this embodiment, the present invention is applied to an electrophotographic copying machine.

The image forming apparatus 100 forms an electrostatic latent image (electrostatic image) on the peripheral surface of its image bearing member 10, which rotates in the direction (counterclockwise direction) indicated by an arrow mark in FIG. 1. Then, it develops the electrostatic latent image into a toner image (developer image) by causing the toner in developer to adhere with the use of its developing means 16. The method used by the image forming apparatus 100 for forming an electrostatic latent image is as follows: First, the peripheral surface of the image bearing member 10 is charged by a charging means 11 (primary charging means), and then, the charged portion of the peripheral surface of the image bearing member 10 is exposed by an information writing means 18 (exposing means) according to the pictorial information, effecting thereby an electrostatic latent image on the peripheral surface of the image bearing means 10. Then, the toner image on the peripheral surface of the image bearing member 10 is transferred by a transferring apparatus 15 onto recording medium. After the transfer of the toner image, the toner particles remaining on the peripheral surface of the image bearing member 10, that is, the toner particles on the peripheral surface of the image bearing member 10, which did not transfer onto the recording medium, are removed and recovered by a cleaning apparatus 13, which is made up of a cleaning means, such as a cleaning blade, a fur brush, or the like, which is in contact with the image bearing member 10. More specifically, the cleaning apparatus 13 scrapes down the toner particles from the peripheral surface of the image bearing member 10 by its cleaning means, and recovers the removed toner particles into storage for the recovered toner. Further, the image forming apparatus 100 is provided with preparatorily irradiating means 12 and 14 (which hereafter will be referred to simply as pre-irradiating means) for removing the electrical charge remaining on the peripheral surface of the image bearing member 10. It is also provided with a fixing means 30 (heating means) for fixing the unfixed toner image on the recording medium P after the transfer of the unfixed toner image onto the recording medium P.

[Description of Essential Structural Components]

Next, each of the essential structural components of the image forming apparatus in this embodiment will be described in detail.

(1) Photosensitive Drum (Image Bearing Member)

The image forming apparatus 100 is provided with a photosensitive drum 10, as an image bearing member, which is an electrophotographic photosensitive member in the form of a rotational drum. The photosensitive member is provided with a photosensitive layer. The photosensitive drum 10 in this embodiment is provided with a photosensitive layer formed of organic photoconductor (OPC) which is negative in the inherent polarity to which it is chargeable. More specifically, the photosensitive drum 10 is made up of an electrically conductive substrate, and a photosensitive layer (photosensitive film formed on the peripheral surface of the substrate in a manner to cover the entirety of the peripheral surface of the substrate. The photosensitive layer includes photoconductive sublayers, the main ingredient of which is organic photoconductor. Generally speaking, a photosensitive member made up of organic photoconductor has a charge generation layer, a charge transfer layer, and a surface protection layer, which are formed, in layers, of organic materials, on the peripheral surface of a metallic substrate (photoconductive layer supporting member), which is an electrically conductive substrate. Incidentally, the choice of the material for the photoconductive layer of the photosensitive drum 10 does not need to be limited to organic photoconductor. For example, amorphous silicon may be chosen as the material for the photoconductive layer. The photosensitive drum 10 (photosensitive member in this embodiment), which is based on amorphous silicon, is made up of an electrically conductive substrate, and a photosensitive layer (photosensitive film) having a photoconductive layer, the main ingredient of which is noncrystalline silicon (amorphous silicon). It is roughly 80 mm in diameter, and is rotationally driven about the central axis (not shown) of the substrate in the direction (counterclockwise) direction shown in FIG. 1.

(2) Charging Device (Charging Means)

The image forming apparatus 100 has a corona discharging device 11 (which hereafter will be referred to simply as charging device 11), which is a noncontact charging means (noncontact charging device) The charging device 11 has a charging wire 11*a* (corona discharging electrode) and an electrode 11*b* in the form of a grid, and a casing 11*c* (shielding case).

The charging wire 11*a* is connected to an external power source through a circuit 62 (FIG. 6) for applying bias to the charging wire 11*a*. Charging wire bias (high voltage) is applied to the charging wire 11*a* to cause the charging wire 11*a* to discharge corona, by which the photosensitive drum 10 is charged. The charging conditions, such as the timing with which the charge bias is turned on or off, the output value of the abovementioned external power source, and the like, are controlled by an information accumulation circuit 50 (FIG. 6) as a controlling means. As the material for the charging wire 11*a*, stainless steel, nickel, molybdenum, or tungsten is desirable. In this embodiment, brown tungsten is used as the material for the charging wire 11*a*. Brown tungsten is one of the very stable metals. Therefore, the charging wire 11*a* in this embodiment can withstand the severe condition (high temperature) to which it is subjected, being therefore very durable, that is, capable of reliably discharge corona for a long period of time.

The charging wire 11*a* is kept stretched by a supporting member which is an integral part of the casing 11*c*, with the provision of a preset amount of tension. In this embodiment, the charging wire 11*a* (corona discharging wire) and casing 11*c* are electrically insulated from each other by the supporting member made of an electrically nonconductive material. The diameter of the charging wire 11*a* is desired to be in a range of 40 μm-100 μm. If the charging wire 11*a* is excessively small in diameter, it may sever due to the ion collision attributable to electrical discharge. On the other hand, if the charging wire 11*a* is excessively large in diameter, the voltage applied to the charging wire 11*a* (corona discharging wire) must be increased to ensure that corona is reliably discharged. The higher the voltage applied to the charging wire 11*a*, the more likely it is for ozone to be generated, and also, the higher the power source cost. In this embodiment, therefore, brown tungsten wire with a diameter of 50 μm is used as the material for the charging wire 11*a*.

Further, in order to adjust the amount of electrical charge to be given to the photosensitive drum 10, that is, the member to be charged, to control the potential level of the photosensitive drum 10, grid bias, that is, the high voltage applied to the grid electrode 11*b* connected to a constant voltage power source 61, is controlled relative to the amount of voltage applied to the charging wire 11*a* to discharge corona. In this embodiment, the grid electrode 11*b* is flat. It is formed of a 0.1 mm thick sheet of SUS. More specifically, the 0.1 mm thick sheet of SUS is masked, etched, and lastly, plated with chrome to a thickness of 1 μm. To the grid electrode 11*b*, negative voltage is applied from the constant voltage power source 61 (grid bias application power source), as a grid bias applying means, which is controllable in voltage to control the potential level to which the photosensitive drum 10 is charged. The charging conditions, such as the timing with which the grid bias is turned on or off, the output value of the constant voltage power source 16, and the like, are controlled by an information accumulation circuit 50 (FIG. 6) as a controlling means.

(3) Exposing Apparatus (Information Writing Means, Image Writing Means)

The image forming apparatus 100 is provided with an exposing apparatus 18, which is an information writing means for forming an electrostatic latent image on the charged portion of the peripheral surface of the photosensitive drum 10. In this embodiment, the exposing apparatus 18 is a laser beam scanner which employs a semiconductor laser which is 660-670 nm in wavelength (λ).

(4) Developing Apparatus (Developing Means)

The developing apparatus 16 (developing device), which is a developing means, develops an electrostatic latent image formed on the photosensitive drum 10, into a visible image, that is, an image formed of toner (which hereafter will be referred to as toner image), by supplying the electrostatic latent image on the photosensitive drum 10, with the toner in developer. In this embodiment, the developing apparatus 16 is such a developing apparatus that uses magnetic two-component developer, and develops in reverse an electrostatic latent image, by forming a magnetic brush. The developing apparatus 16 has a developing means container 16*a*, and a development sleeve 16*b* as a developer bearing member. The developing means container 16*a* contains the two-component developer, and the development sleeve 16*b*. The two-component developer is a mixture of primarily nonmagnetic toner (toner) and magnetic carrier (carrier). In this embodiment, the magnetic carrier is roughly $5\times10^8$ ohm·cm in electrical resistance, and 35 μm in average particle diameter. Toner becomes negatively charged by being rubbed against the magnetic carrier.

When the image forming apparatus 100 is in a developing operation, the development sleeve 16*b* is positioned so that the shortest distance (S-D gap) between the peripheral surface of the development sleeve 16*b* and that of the photosensitive drum 10 is 350 μm. This area between the development sleeve 16*b* and photosensitive drum 10, in which the distance between the development sleeve 16*b* and photosensitive drum 10 is shortest, is the developing portion. The development sleeve 16*b* is rotationally driven in such a direction that the peripheral surface of the development sleeve 16*b* and that of the photosensitive drum 10 move in the same direction in the developing portion.

The development sleeve 16*b* is provided with a magnetic roller, which is a magnetic field generating means and is located in the hollow of the development sleeve 16*b*. The two-component developer is borne on the peripheral surface of the development sleeve 16*b* by the magnetic force from the magnetic roller, and is conveyed to the developing portion by the rotation of the development sleeve 16*b*. As the two-component developer is borne on the peripheral surface of the development sleeve 16*b*, it is made to crest by the magnetic field generated by the magnetic roller, forming thereby a magnetic brush. As the development sleeve 16*b* is rotated, the body of two-component developer on the development sleeve 16*b* is regulated in thickness by a developer coating blade (not shown) as a developer regulating means, being thereby formed into a thin layer of developer with a preset thickness.

To the development sleeve 16*b*, a preset development bias (high voltage) is applied from a development bias application power source 63 (not shown) as a development bias applying means. In this embodiment, the development bias applied to the development sleeve 16*b* is an oscillatory voltage, more specifically, a combination of DC voltage ($V_{DC}$) and AC voltage ($V_{AC}$). The development bias application power source 63 is controlled by the information accumulation circuit 50 (FIG. 6) as a controlling means, in terms of such parameters as the timing with which the development bias is turned on or off, output value, etc. The toner in the two-component developer is adhered to the numerous points of the peripheral surface of the photosensitive drum 10, which have been reduced in potential level, effecting thereby an electrostatic latent image on the peripheral surface of the photosensitive drum 10. As a result, the electrostatic latent image turns into a toner image, that is, an image formed of toner. The amount of electrical charge which the toner having transferred onto the photosensitive drum 10 from the development sleeve 16*b* is roughly −30 μC/g. The developer which remains on the development sleeve 16*b* after moving through the developing portion is moved back into the developer enclave in the developing means container 16*a* by the subsequent rotation of the development sleeve 16*b*.

Incidentally, in this embodiment, the image forming apparatus 100 has multiple developing apparatuses 16, that is, developing apparatus 16Y, developing apparatus 16M, developing apparatus 16C, and developing apparatus 16K, which are for developing an electrostatic latent image into yellow (Y), magenta (M), cyan (C), and black (B) toner images, respectively. These developing apparatuses 16Y, 16M, 16C, and 16K are held by a developing apparatus holding rotary 21, which can be rotationally driven. The four developing apparatuses 16 and rotary 21 make up a rotational development unit 21. The image forming apparatus 100 is structured so that a desired developing apparatus 16, that is, any developing apparatus 16, can be moved into the developing portion by rotating the rotary 21, to develop an electrostatic latent image into a monochromatic toner image of a desired color. Incidentally, the developing apparatuses 16Y, 16M, 16C, and 16K are practically identical in structure and operation, although they are different in the color of the toner they use. In this specification, therefore, unless it is necessary to differentiate the four developing apparatuses 16 in terms of the color of the toner they use, letters Y, M, C, and K, which are assigned to show the color of the toner they use, are omitted hereafter, in order to inclusively described all four developing apparatuses 16Y, 16M, 16C, and 16K.

(5) Transferring Apparatus

In this embodiment, the transferring apparatus 15 has an intermediary transfer belt 15*a* (intermediary transferring member) and a primary transfer roller 15*b* (primary transferring member). The intermediary transfer belt 15*a* is a transferring means, and is an endless belt. The primary transfer roller 15*b* is located in the inward side of a loop which the intermediary transfer belt 15*a* forms. It is kept pressed against the photosensitive drum 10 by the application of a predetermined amount of pressure, with the presence of the intermediary transfer belt 15*a* between the photosensitive drum 10 and primary transfer roller 15*b*. The area of contact between the intermediary transfer belt 15*a* and photosensitive drum 10 forms a compression nip, which constitutes a primary transfer nip N1.

The intermediary transfer belt 15*a* is circularly moved in the direction (clockwise direction) indicated by an arrow mark in the drawing, while remaining pinched by the photosensitive drum 10 and primary transfer roller 15*b*. To the primary transfer roller 15*b*, a primary transfer bias (high voltage) is applied from a primary transfer bias application power source 65 (FIG. 6) as a means for applying the primary transfer bias. In this embodiment, the polarity of the primary transfer bias is opposite to the normal polarity (negative in this embodiment) to which toner is charged. In other words, the primary transfer bias in this embodiment is positive in polarity. In this embodiment, the primary transfer bias is +2.5 kV. The primary transfer bias application power source 64 is controlled by the information accumulation circuit 50 (FIG. 6), as a controlling means, in terms of such parameters as the timing with which the primary transfer bias is turned on or off, value of its output of the primary transfer bias application power source 64, etc. Thus, as the primary transfer bias is applied to the primary transfer roller 15*b*, the toner image on the photosensitive drum 10 is electrostatically transferred (primary transfer) onto the surface of the intermediary transfer belt 15*a* (primary transfer medium).

The transferring apparatus 15 has a secondary transfer roller 15*c* (secondary transferring member), which is located on the outward side of the loop which the intermediary transfer belt 15*a* forms. The secondary transfer roller 15*c* is kept pressed against one of the rollers which keep suspended the intermediary transfer belt 15*a*, with the presence of the intermediary transfer belt 15*a* between the secondary transfer roller 15*c* and opposing roller. Thus, a compression nip is formed between the secondary transfer roller 15*c* and intermediary transfer belt 15*a*. This compression nip is a secondary transfer portion N2. To the secondary transfer roller 15*c*, a secondary transfer bias (high voltage) is applied from a secondary transfer bias application power source (not shown), which is the means for applying the secondary transfer bias. The polarity of the secondary transfer bias is opposite to the normal polarity to which toner is charged. In other words, the polarity of the secondary transfer bias in this embodiment is positive. As the secondary transfer bias is applied to the secondary transfer roller 15*c*, the toner image (s) on the intermediary transfer belt 15*a* is electrostatically transferred (secondary transfer) onto a sheet of recording medium P, in the secondary transferring portion N2. The sheet of recording medium P is conveyed to the secondary transferring portion N2 by a means different from the means by which the toner images are conveyed to the secondary transferring portion N2.

(6) Cleaning Apparatus

In this embodiment, the cleaning apparatus 13 employs a cleaning blade 13*a* and a fur brush 13*b* as cleaning means. It also has a container 13*c* for storing the toner removed from the photosensitive drum 10 by the cleaning means. More specifically, the toner remaining on the photosensitive drum 10 after the primary transfer is recovered by the fur brush 13*b*, into the container 13*c* for the recovered toner. The cleaning blade 13*a* is formed of an elastic material such as urethane rubber, and is kept pressed upon the peripheral surface of the photosensitive drum 10 so that a preset amount of pressure is maintained between the cleaning blade 13*a* and the peripheral surface of the photosensitive drum 10. The cleaning blade 13*a* removes from the peripheral surface of the photosensitive drum 10, the toner which the fur brush failed to recover. The toner removed by the cleaning blade 13*a* is also recovered into the container 13*c* for the recovered toner.

(7) Charge Removing Means (Surface Potential Resetting Means)

The image forming apparatus 100 in this embodiment is provided with the first pre-irradiating device 12 (pre-exposure lamp) and second pre-irradiating apparatus 14 (pre-exposure lamp). The first pre-irradiating device 12 is the means for removing electrical charge from the photosensitive drum 10, and the second pre-irradiating device 14 is the means for exposing the photosensitive drum 10 immediately before the photosensitive drum 10 is cleaned by the cleaning apparatus 13. After the primary transfer of the toner image, the peripheral surface of the photosensitive drum 10 is exposed by the two pre-irradiating means to reset the potential level of the peripheral surface of the photosensitive drum 10 in order to prevent the formation of an image which suffers from a ghost. In this embodiment, each of the first and second pre-irradiating devices 12 and 14 is an array of LEDs, which is in the form of a chip (product of Stanley Co., Ltd.), and which is 660 nm in central wavelength. Each of the first and second pre-irradiating devices 12 and 14 makes up a charge removing means (surface potential resetting means) capable of removing (resetting) at least a part of the surface potential of the photosensitive drum 10. The first and second pre-irradiating devices 12 and 14 are connected to the pre-charging exposing device driving circuit 65 (FIG. 6) and pre-cleaning exposing device driver circuit 66 (FIG. 6), respectively, which are the portions for controlling the driving of the two pre-irradiating devices 12 and 14, respectively. The exposing conditions, such as the timing with which the exposing devices 12 and 14 are turned on or off, the light output values (amount of light) of the pre-charging exposing device driver circuit 65, and pre-cleaning exposing device driver circuit 66, etc., are controlled by the information accumulation circuit 50 (FIG. 6) as a controlling means.

Incidentally, in this embodiment, the primary transfer roller 15*b* also makes up a means which removes (resets) at least a part the surface potential of the photosensitive drum 10, as will be described later.

(8) Potential Level Sensor (Surface Potential Level Detecting Means)

Figure 6:
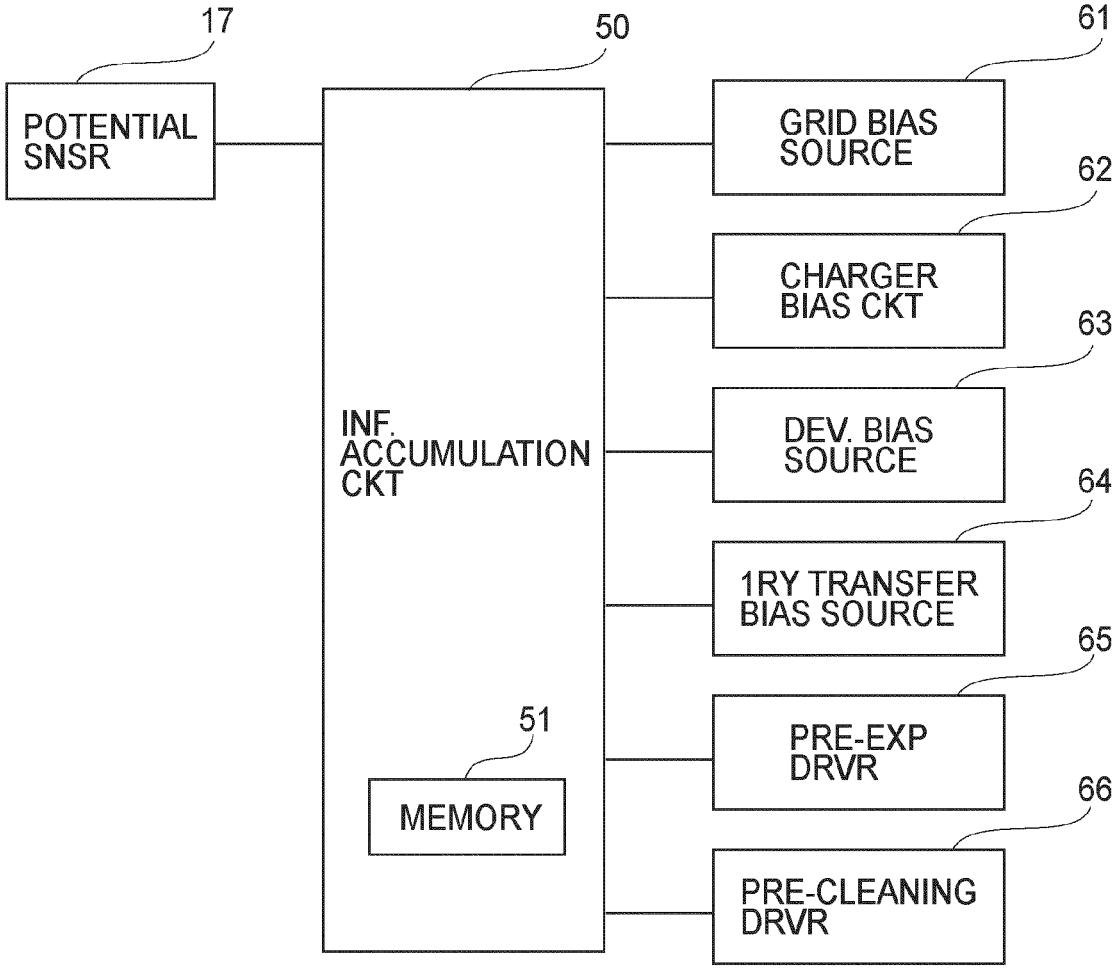
FIG. 6 is a block diagram of the control mode for the image forming apparatus in the first embodiment.

The image forming apparatus 100 in this embodiment is provided with a potential level sensor 17, which is the surface potential level detecting means for detecting the surface potential level of the photosensitive drum 10, and which is located next to the peripheral surface of the photosensitive drum 10. The electrical signals outputted from the potential level sensor 17 are inputted into the information accumulation circuit 50 (FIG. 6). The charging conditions, such as the timing with which the charge bias is turned on or off, the output value of the abovementioned external power source, and the like, are controlled are controlled by the information accumulation circuit 50 (FIG. 6) as a controlling means.

(9) Fixing Apparatus (Fixing Means)

The image forming apparatus 100 is also provided with the fixing apparatus 30, which is a fixing means for fixing to the recording medium P, the unfixed toner images on the sheet of recording medium P, that is, the toner images having just been transferred onto the recording medium P. The fixing apparatus 30 has a heating roller 31 and a pressing roller 32. The heating roller 31 contains a heat source. The pressing roller 32 is kept pressed upon the heating roller 31, forming thereby a compression nip between the two rollers 31 and 32. The recording medium P is conveyed through this compression nip while remaining pinched by the two rollers 31 and 32, whereby the unfixed toner images on the surface of the recording medium P are welded to the surface of the recording medium P.

[Image Forming Operation]

Referring to FIG. 1, the points, at which the above-described essential structural members of the image forming apparatus 100 in this embodiment, process the photosensitive drum 10, are arranged in the following order in terms of the rotational direction of the photosensitive drum 10 (moving direction of peripheral surface of photosensitive drum 10). That is, the charging position p1 where the peripheral surface of the photosensitive drum 10 is charged by the charging device 11, is the first processing position p1, or the referential position. The second processing position is the exposing position p2 (image writing position) where the peripheral surface of the charged portion of the peripheral surface of the photosensitive drum 10 is exposed by the exposing apparatus 18. The third processing position p3 is the surface potential detecting position at which the surface potential level of the photosensitive drum 10 is detected by the surface potential level sensor 17. The fourth processing position p4 is the position at which the latent image written on the peripheral surface of the photosensitive drum 10 is developed by the developing apparatus 16. The fifth processing position p5 is the position at which the peripheral surface of the photosensitive drum 10 is exposed by the pre-cleaning exposing device 14. The sixth processing position p6 is the position at which the portion of the peripheral surface of the photosensitive drum 10, which has just been preparatorily exposed by the pre-cleaning exposing device 14, is cleaned by the cleaning apparatus 13. The eight processing position p8 is the position at which the portion of the peripheral surface of the photosensitive drum 10, which has just been cleaned by the cleaning apparatus 13, is exposed by the pre-charging exposing device 12.

To roughly describe the image forming operation of the image forming apparatus 100 with reference to its full-color image forming operation, first, the peripheral surface of the photosensitive drum 10 is uniformly charged by the charging device 11. Then, the charged portion of the peripheral surface of the photosensitive drum 10 is exposed by the exposing apparatus 18. More specifically, it is scanned by a beam of laser light emitted by the exposing apparatus 18, while being modulated with electrical signals which reflect the pictorial information for the first primary color (yellow, for example). As a result, an electrostatic latent image, which reflects the pictorial information for the first color, is effected on the peripheral surface of the photosensitive drum 10. Then, this electrostatic latent image is developed into a monochromatic toner image of one of the primary colors (monochromatic yellow toner image) by the developing apparatus 16 (which uses developer made up of yellow toner). Then, the monochromatic toner image on the photosensitive drum 10 is transferred (primary transfer) onto the intermediary transfer belt 15*a*, in the primary transferring portion N1.

The above-described processes, that is, charging process, developing process, and primary transferring process, are sequentially carried out for the other primary colors (magenta, cyan, and black, for example). As a result, four monochromatic toner images different in color (yellow, magenta, cyan, and black monochromatic toner images) are sequentially transferred in layers onto the intermediary transfer belt 15*a*, creating thereby a single multilayer toner image.

Meanwhile, a sheet of recording medium P is conveyed to the secondary transferring portion N2, in synchronism with the timing with which the toner images on the intermediary transfer belt 15*a* arrive at the secondary transferring portion N2. In the secondary transferring portion N2, the toner images on the intermediary transfer belt 15*a* are transferred together (secondary transfer) onto the recording medium P.

Thereafter, the recording medium P is separated from the intermediary transfer belt 15*a*, and then, is conveyed to the fixing apparatus 30, in which the toner images (unfixed toner images) on the recording medium P are fixed to the recording medium P by heat and pressure. Then, the recording medium P is discharged from the image forming apparatus 100.

After a given portion of the peripheral surface of the photosensitive drum 10 has moved past the primary transferring portion N1, it is exposed by the pre-cleaning exposing device 14, whereby at least a part of its electrical charge is removed. Thereafter, the toner particles (primary transfer residual toner particles) remaining on this portion of the peripheral surface of the photosensitive drum 10 after the primary transfer are removed and recovered by the cleaning apparatus 13. Then, the given portion (cleaned portion) is exposed by the pre-charging exposing device 12, whereby the electrical charge is removed. Then, it is uniformly charged again by the charging device 11 to be used for the next round of image formation.

Incidentally, the image forming apparatus 100 can form a multicolor image as well as a monochromatic image of a desired color. The process for forming a multicolor image is practically the same as the above-described process for forming a monochromatic image, except for the difference in the number of developers to be used.

[Potential Level Control]

Regarding the density of a toner image, the image forming apparatus 100 is controlled in the surface potential level of its photosensitive drum 10 so that the contrast voltage $V_{CONT}$ falls in a preset range.

Incidentally, in this embodiment, the polarity to which the photosensitive drum 10 is charged is negative. Further, the method used to form a latent image on the peripheral surface of the photosensitive drum 10 is the so-called scanning method, which scans the image formation area of the peripheral surface of the photosensitive drum 10 with a beam of light (laser light, for example) to form a latent image. The latent image is developed in reverse. More specifically, the electrostatic latent image on the peripheral surface of the photosensitive drum 10 is developed by adhering the toner charged to the same polarity as the polarity to which the photosensitive drum 10 is charged, to the numerous points of the peripheral surface of the photosensitive drum 10, which have reduced in the amount of electrical charge due to the above-described scanning (exposure) of the peripheral surface of the photosensitive drum 10. In the specification of this patent application, however, the amount of the surface electrical charge (potential) of the photosensitive drum 10, and the like, are expressed in absolute value (without referring to polarity), for the sake of the simplification of the following description of this embodiment. Thus, the comparison between the surface potential level of the photosensitive drum 10 at one of the abovementioned processing positions, and that at another is made in terms of absolute value. Needless to say, this embodiment is not intended to limit the present invention in terms of the polarity to which the photosensitive drum 10 is to be charged, exposing method (selective exposing points to which toner is to be adhered, or points to which toner is not to be adhered), developing method (reversal developing method or normal developing method), etc.

Figure 7:
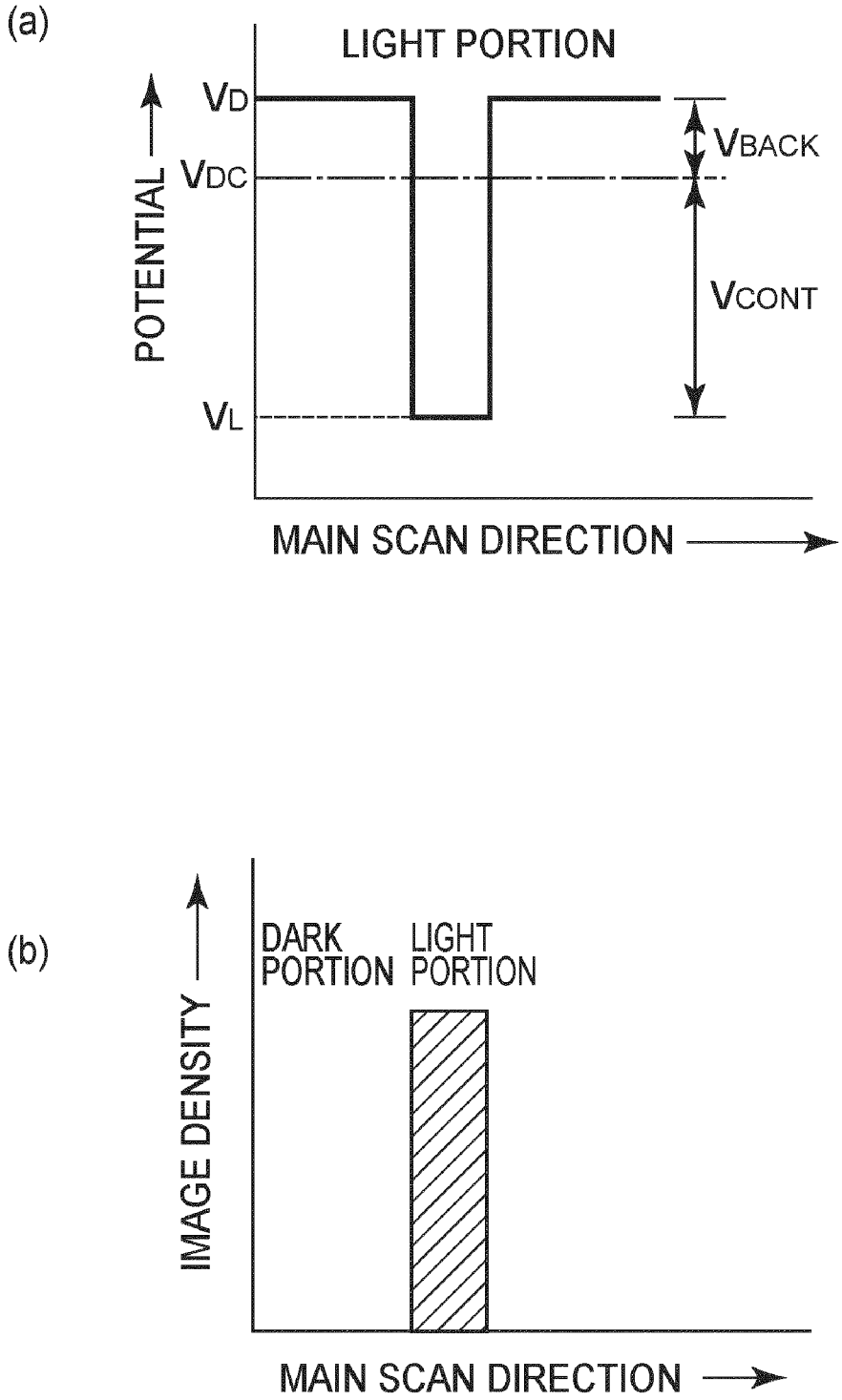
FIG. 7 is a schematic drawing which depicts the relationship between the development bias voltage and image density.

Contrast voltage $V_{CONT}$ is the difference between the surface potential level $V_L$ of an exposed point of the peripheral surface of the photosensitive drum 10, and the level of the development bias voltage (DC component). FIG. 7 shows the relationship between the contrast voltage $V_{CONT}$ and the resultant density (image density) of a toner image (in case where latent image is formed by scanning). In FIG. 7(*a*), the vertical axis represents surface potential level, and the horizontal axis represents the distance from the abovementioned referential position in terms of the primary direction of the scanning (direction parallel to rotational axis of photosensitive drum 10). Thus, FIG. 7(*a*) shows the relationship between the surface potential level of the photosensitive drum 10 and the development bias voltage $V_{DC}$ applied to the developing apparatus 16, in particular, immediately after the potential of a given point of a given portion of the peripheral surface of the photosensitive drum 10 is reduced to a level $V_L$ (post-exposure potential level) by exposing this point immediately after this point of the peripheral surface of the photosensitive drum 10 was uniformly charged to a preset level $V_D$ (pre-exposure potential level). As will be evident from FIG. 7(*a*), there is a potential level difference $V_{BACK}$ between the pre-exposure potential level $V_D$ and development bias voltage level $V_{DC}$. The value of this difference $V_{BACK}$ (fog removal potential) in potential level is set to be no less than a value set for preventing the toner from adhering to an unexposed point of the charged portion of the peripheral surface of the photosensitive drum 10. In the case of FIG. 7(*b*), the vertical axis represents image density, and the horizontal axis represents the distance from the aforementioned referential position, in terms of the primary direction of the scanning. Thus, FIG. 7(*b*) shows the image density distribution of an image formed by adhering to the exposed points when the condition of the peripheral surface of the photosensitive drum 10 was as shown in FIG. 7(*a*).

Figure 8:
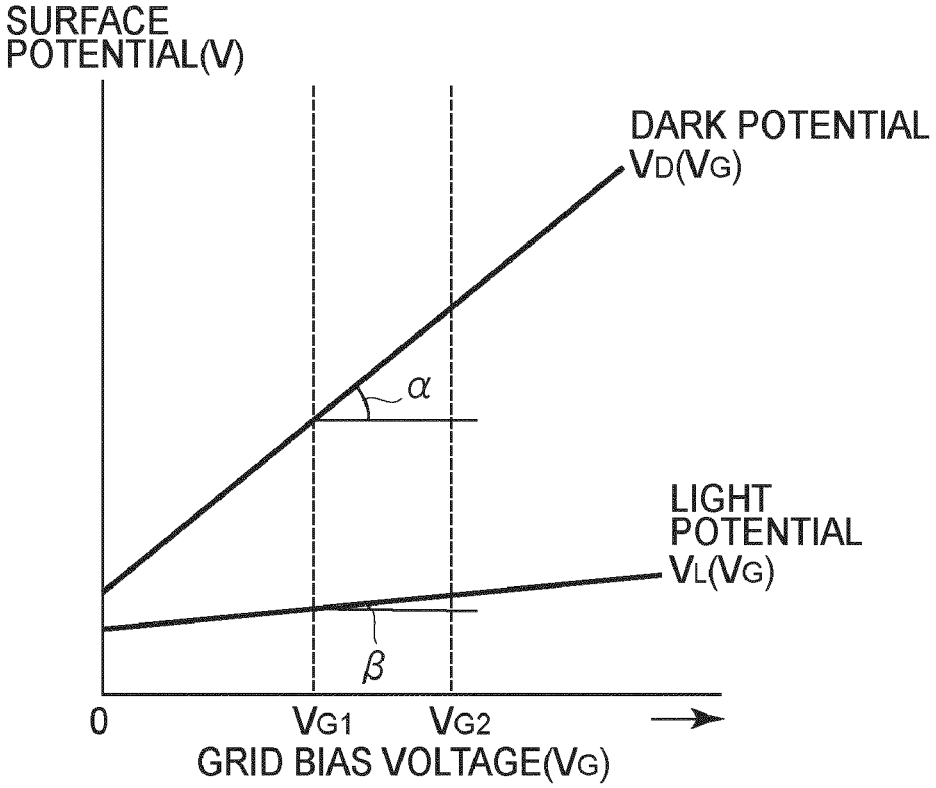
FIG. 8 is a graph which shows an example of a method for controlling the potential level of a photosensitive member.

To describe further, in order to carry out the above-described potential level control, the image forming apparatus 100 is provided with the potential level sensor 17, which is located in the immediate adjacencies of the peripheral surface of the photosensitive drum 10 to measure the surface potential level of the photosensitive drum 10. To this potential level sensor 17, the information accumulation circuit 50 (FIG. 6), which is a controlling means, is connected. First, the information accumulation circuit 50 calculates the necessary amount of contrast voltage $V_{CONT}$, from the data which is set in relation to the environment, in which the image forming apparatus 100 is used. This date is stored in the storage portion 51 (FIG. 6), as an internal storage means. Then, the characteristic (in the form of linear approximation equation which includes inclinations α, β, etc., as shown in FIG. 8) of the photosensitive drum 10 in terms of the change in potential level is obtained by measuring the light potential level and dark potential level while varying the grid bias applied to the charging device 11. In FIG. 8, the horizontal axis represents the level of the grid bias voltage applied to the charging device 11, and the vertical axis represents the level of the surface potential of the photosensitive drum 10. That is, in FIG. 8, the line $V_D(V_G)$ shows the characteristic of the photosensitive drum 10 in terms of the effect of the change in the grid bias voltage, upon the dark potential level of the peripheral surface of the photosensitive drum 10, and the line $V_L(V_G)$ shows the characteristic of the photosensitive drum 10 in terms of the effect of the change in the level of the grid bias voltage, upon the light potential level of the peripheral surface of the photosensitive drum 10. In this case, the exposing means (image writing means) is designed so that the amount of its exposure light remains set to a value which is used as the referential value for the contrast voltage $V_{CONT}$ necessary under the environment in which an image forming apparatus is used.

Then, the value of the grid bias voltage $V_G$, which corresponds to the value of the abovementioned necessary contrast voltage $V_{CONT}$, is obtained from the characteristic of the photosensitive drum 10 in terms of the change in potential, and the relationship among $V_{CONT}$, $V_{DC}$, and $V_{BACK}$, shown in FIG. 7. Further, from these relationships, the values of $V_L$, $V_D$, and $V_{DC}$, which correspond to the value of the grid bias voltage $V_G$ are obtained. These values are obtained according to the target values for $V_{BACK}$ and $V_{CONT}$, and are stored in the storage portion 51. Further, these values are obtained for each primary color, and are stored in the storage portion 51.

As for the settings of the grid bias voltage $V_G$, and the like, they are adjusted in consideration of the dark attenuation of the photosensitive drum 10, so that proper amounts of $V_{CONT}$ and $V_{BACK}$ are provided at the developing position p4, as will be described later in detail.

Incidentally, the above-described potential controlling method is only one of the methods available for controlling the potential level of a photosensitive member. In other words, the above-described potential controlling method in this embodiment is not intended to limit the present invention in terms of the method for controlling the potential level of a photosensitive member; the method to be used for controlling the potential level of a photosensitive member is optional.

[Compensation for Dark Attenuation]

The image forming apparatus 100, which is an electrophotographic image forming apparatus, detects the surface potential level of its photosensitive drum 10 by the potential level sensor 17 located in the image forming apparatus 100, and adjusts the surface potential level of the photosensitive drum 10 according to the detected value of the surface potential level of the photosensitive drum 10. Ideally, the potential level sensor 17 is to be positioned in parallel to the area in which the distance between the development sleeve 16*b* and photosensitive drum 10 is smallest. In reality, however, in many cases, the potential level sensor 17 is positioned slightly away from the developing portion, as shown in FIG. 1, in consideration of the scattering of developer and apparatus structure.

Therefore, the surface potential level of the photosensitive drum 10 at the developing portion becomes different from that measured at the position of the potential level sensor 17, because the characteristic of the photosensitive drum 10 in terms of dark attenuation. Thus, if the accurate amount of the dark attenuation of the photosensitive drum 10 cannot be obtained, it is sometimes impossible to accurately control the surface potential of the photosensitive drum 10. Without accurately knowing the surface potential level of the photosensitive drum 10, it cannot be ensured that a proper amount of fog removal potential (voltage) is provided. Without the provision of a proper amount of fog removal voltage, the image forming apparatus is likely to output an image which is inferior in terms of fog. In addition, with the increases in the cumulative length of usage of the photosensitive drum 10, the photosensitive drum 10 reduces in chargeability, and also, increases in the amount of dark attenuation, which in turn increases the amount of the fog from which the images which will be formed by the image forming apparatus 100 will suffer.

Thus, one of the objects of this embodiment of the present invention is to compensate for the effect of the dark attenuation of the photosensitive drum 10 to make it possible to more precisely control the image formation condition. Another object of this embodiment is to provide a method for controlling the surface potential of the photosensitive drum 10, which is capable of compensating for the dark attenuation of the photosensitive drum 10 to prevent the fog formation. Another object of this embodiment is to propose a method for measuring the amount of the dark attenuation of a photosensitive drum 10, which does not obtain the amount of the dark attenuation by measuring the potential level of the photosensitive drum 10 before and after rotating the photosensitive drum 10 one full turn, being therefore not affected by the components which are in contact, or come into contact, with the photosensitive drum 10, and which therefore is capable of more accurately obtaining (estimating) the amount of the dark attenuation of the photosensitive drum 10.

The image forming apparatus 100, in this embodiment, which achieves the abovementioned objects is structured as follows: The condition under which the charge removing means (surface potential level resetting means) is operated can be varied, and the peripheral surface of the photosensitive drum 10 is charged by the charging device 11 under the abovementioned various operational conditions for the charge removing means after it is moved past the position at which the charging removing means acts on the photosensitive drum 10. Then, the surface potential level of the photosensitive drum 10 is measured by the potential level sensor 17. Then, the image formation condition is changed (adjusted) according to the results of the measurement. To describe in more detail, the amount of the dark attenuation of the photosensitive drum 10 is calculated for each of the surface potential levels of the photosensitive drum 10, which are detected (measured) by the potential level sensor 17 under the various conditions under which the abovementioned charge removing means was operated. Then, the image formation condition of the image forming apparatus 100 is changed (adjusted) according to the calculated (estimated) amount of the dark attenuation of the photosensitive drum 10. This embodiment is characterized in that the amount of the dark attenuation of the photosensitive drum 10 is calculated (estimated) based on the differences between the value of the surface potential level, which is detected by the potential level sensor 17 after the charge removing member is operated under one of the abovementioned various operational conditions therefor, and that under another operational condition. To describe in more detail, the amount of the dark attenuation of the photosensitive drum 10 which occurs while a given point on the peripheral surface of the photosensitive drum 10 moves from the surface potential detecting position of the potential level sensor 17 to the developing position of the developing apparatus 16 is obtained in advance. Then, the amount of the dark attenuation is calculated based on the relationship between the amount of the dark attenuation of the photosensitive drum 10 obtained in advance, and the above-described difference. In other words, this embodiment is characterized in that the potential level to which the photosensitive drum 10 is to be charged, that is, one of the parameters of the image formation condition, is changed (adjusted) according to the amount of the dark attenuation, which is calculated (estimated) with the use of the above-described method.

More concretely, in this embodiment, the pre-irradiating means are made variable in the irradiating condition (which hereafter will be referred to as "pre-irradiation condition"), and the photosensitive drum 10 is charged under each of the various pre-irradiation conditions. Then, the amount of the dark attenuation of the photosensitive drum 10 is calculated based on the differences among the values of the surface potential level of the photosensitive drum 10, which are obtained under the various pre-irradiation conditions. Then, the thus obtained (estimated) amount of the dark attenuation of the photosensitive drum 10 is reflected upon the controlling of the surface potential level of the photosensitive drum 10. Incidentally, instead of varying the pre-irradiation condition, the bias (which hereafter will be referred to as "transfer high voltage") which is applied to the transferring means may be varied. That is, as the means for varying the operational condition for the charge removing means, either the pre-irradiation condition (irradiation condition for first pre-irradiating apparatus, and irradiation condition for second pre-irradiating apparatus), or combination of the irradiation condition for the first pre-irradiating apparatus and the irradiation condition for the second pre-irradiating apparatus. That is, the abovementioned various conditions under which the charge removing means is operated includes at least one of the following operational conditions: the condition that the pre-irradiating means which irradiates the photosensitive drum 10 at a location which is on the downstream side of the transferring position and on the upstream side of the charging position, in terms of the moving direction of the peripheral surface of the photosensitive drum 10, is varied, and the condition that the bias applied to the transferring means which transfers a toner image formed on the photosensitive drum 10, onto transferring medium is varied. Next, these operational conditions will be described in more detail.

Figure 2:
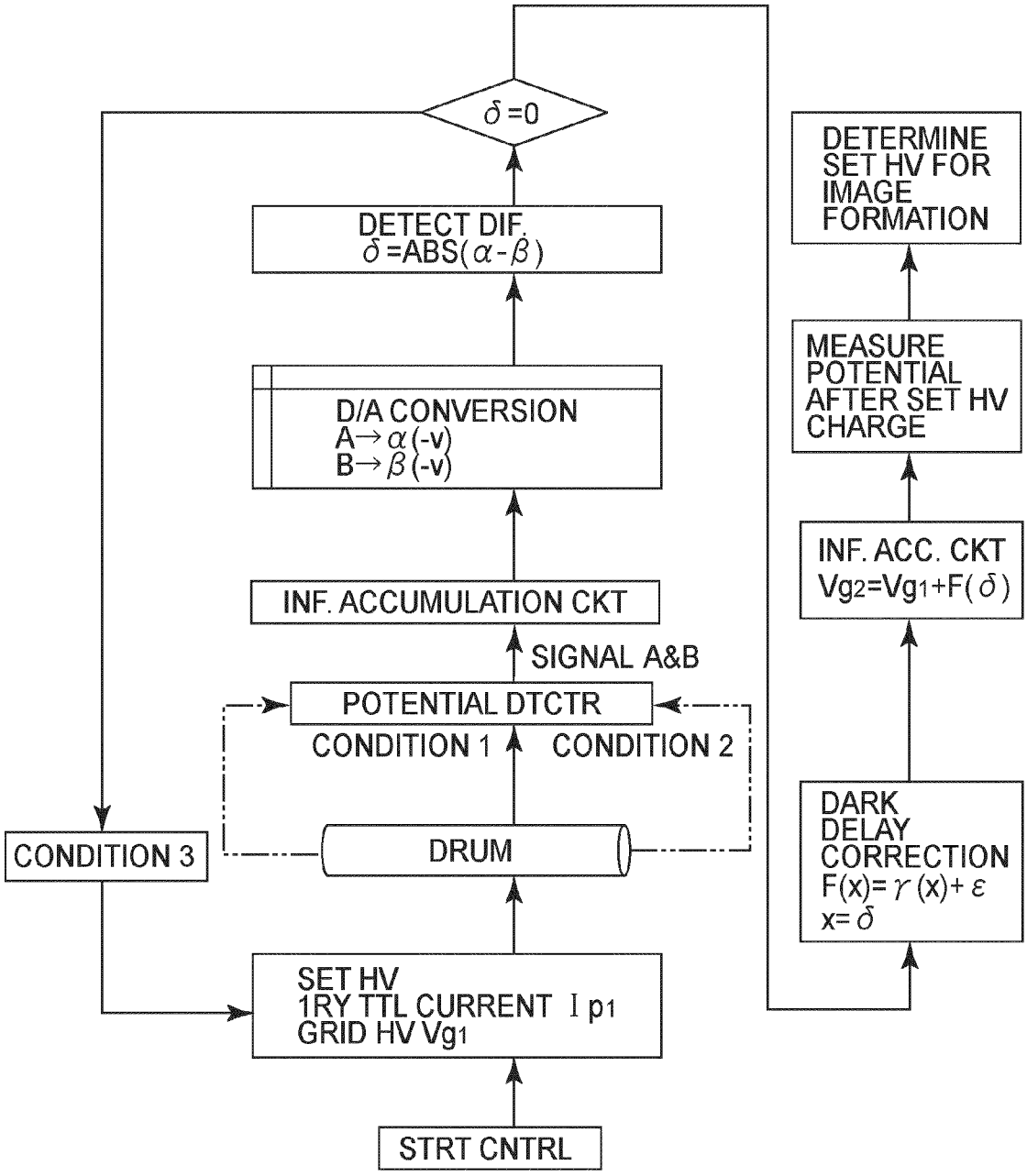
FIG. 2 is a flowchart of the dark attenuation measurement mode of the image forming apparatus shown in FIG. 1.

In this embodiment, the image forming apparatus 100 is provided with a mode for measuring the amount of dark attenuation (which hereafter will be referred to as dark attenuation amount measurement mode), as a means for calculating the amount by which compensation is to be made for dark attenuation, the flowchart of which is FIG. 2. Thus, the image forming apparatus 100 controls the potential level of the photosensitive drum 10 by selecting the optimal amount of compensation, in response to the output signals of the potential level sensor 17. The dark attenuation amount measurement mode, in which the image forming apparatus 100, in this embodiment, structured as described above, can be operated, is as follows.

The timing for starting the dark attenuation amount measurement mode is, for example, immediately after the main power source of the image forming apparatus 100 is turned on, while the temperature of the heating roller 31 of the fixing apparatus 30 is no higher than 50° C. This setup has a merit in that the length of time usable for obtaining the characteristic of the photosensitive drum 10 in terms of the change in the dark attenuation is long enough for measuring the amount of dark attenuation, while being short enough to be included in the ordinary waiting period, that is, the time necessary for the image forming apparatus 100 to be started up after the main power source of the image forming apparatus 100 is turned on. That is, it has a merit in that it can eliminate the time which has be reserved for operating the image forming apparatus in the dark attenuation amount measurement mode.

First, referring to FIG. 6 (rough block diagram) and FIG. 2 (flowchart), the operation for controlling the surface potential level of the photosensitive drum 10, in this embodiment, will be described. Conditions 1, 2, and 3 in FIG. 2 are the conditions for calculating the amount of the dark attenuation of the photosensitive drum 10, which is to be reflected upon the setting of the high voltage values. The details of Conditions 1, 2, and 3 will be described later in detail.

First, the photosensitive drum 10 charged by the charging device 11 is charged under two conditions, which are different in the setting of the transfer high voltage and the amount of pre-irradiation (setting of two charging removing means), while the high voltage (total primary current, grid high voltage, etc.) applied to the charging device 11 is kept at a preset level. During this step, the information accumulation circuit 50, which is a controlling means, controls the grid bias application power source 61, charge wire bias application circuit 62, primary transfer bias application power source 64, first pre-irradiating device driver circuit 65, second pre-irradiating device driver circuit 66, etc., so that they operate under preset conditions.

Next, the surface potential level of the photosensitive drum 10 is obtained by the potential level sensor 17 after the photosensitive drum 10 is charged under each of the above-described conditions. The output signals from the potential level sensor 17 are inputted into the information accumulation circuit 50, which converts the output signals (analog signals) into digital signals.

Next, the computation control portion of the information accumulation circuit 50 obtains the absolute value of the difference δ between the value of the surface potential level of the photosensitive drum 10 obtained under one of the above-described two conditions, and that obtained under the other condition. In this embodiment, the image forming apparatus 100 is structured so that if the absolute value of the difference δ between the potential level of the photosensitive drum 10 obtained under Condition 1 and that under Condition 2 is zero, the surface potential level of the photosensitive drum 10 is measured under Condition 3 using the same method as the above described one, and the absolute value of the difference δ between the potential level of the photosensitive drum 10 obtained under Condition 1 and that under Condition 3 is obtained. Thus, if the absolute value of the difference δ is zero, it is determined that it is highly possible that because of some problems, the potential level of the photosensitive drum 10 was measured under the same conditions (for example, the pre-irradiating devices were not on). In such a case, another condition is used as a countermeasure for the problems.

Then, the information accumulation circuit 50 substitutes the value of the potential level of the photosensitive drum 10 for δ in the equation for calculating the amount of the dark attenuation of the photosensitive drum 10. In other words, the information accumulation circuit 50 functions as a means for compensating for the dark attenuation of the photosensitive drum 10. The abovementioned equation is derived from the values of the potential level of the photosensitive drum 10 obtained in advance under the same conditions as those for the dark attenuation amount measurement mode, and stored in the internal storage portion 51 of the information accumulation circuit 50.

Thereafter, the information accumulation circuit 50 adjusts the high voltage (which in this embodiment is grid high voltage) to be applied to the charging device 11, according to the amount of the dark attenuation obtained by substituting the values of the potential level of the photosensitive drum 10 obtained under the above-described condition, for δ in the equation for calculating the amount of the dark attenuation of the photosensitive drum 10. Typically, in order to charge the peripheral surface of the photosensitive drum 10 by the charging device 11 to such a level that the surface potential level of the photosensitive drum 10 will have a proper value at the developing position p4, the high voltage to be applied to the charging device 11 is increased by the amount which corresponds to the amount of the calculated amount of the dark attenuation. Then, the photosensitive drum 10 is charged under the condition in which the revised high voltage is applied to the charging device 11. Then, the surface potential level of the photosensitive drum 10 is measured by the potential level sensor 17 to determine whether or not the photosensitive drum 10 has been charged to a proper level. Then, the condition under which the charging device 11 is to be operated during a normal image forming operation is determined; for example, the amount of high voltage to be applied to the charging device 11 for a normal image forming operation is determined. That is, in this embodiment, the first measurement of the surface potential level of the photosensitive drum 10 is for compensating for the effect of the dark attenuation of the photosensitive drum 10, and the second measurement of the surface potential level of the photosensitive drum 10 is for setting the value for the high voltage to be applied to the charging device 11 during a normal image forming apparatus. More specifically, the surface potential level of the photosensitive drum 10 is measured for the second time to confirm whether or not the revision of the high voltage to be applied to the charging device 11 was successful for compensating for the effect of the dark attenuation of the photosensitive drum 10. If the revision was successful, the value for the dark potential level and the value for the light potential level are set according to the revision so that a proper charging condition ($V_{CONT}$, $V_{BACK}$) is provided for a normal image forming operation. The value chosen for the high voltage to be applied to the charging device 11, and the like, are stored in the storage portion 51 of the information accumulation circuit 50, and is used for the following image forming operation. In this embodiment, the image forming apparatus 100 is designed so that the development bias is also revised in accordance with the revised value for the high voltage to be applied to the charging device 11. That is, in this embodiment, the value for the bias to be applied to the charging device 11, that is, the value is used for controlling the surface potential level of the photosensitive drum 10, or the value for the bias to be applied to the developing apparatus 16, can be adjusted according to the obtained amount of the dark attenuation.

Next, the equation for calculating the amount by which compensation is to made for dark attenuation will be described. First, the equation in Example 1 (which will be described later) will be described.

Figure 4:
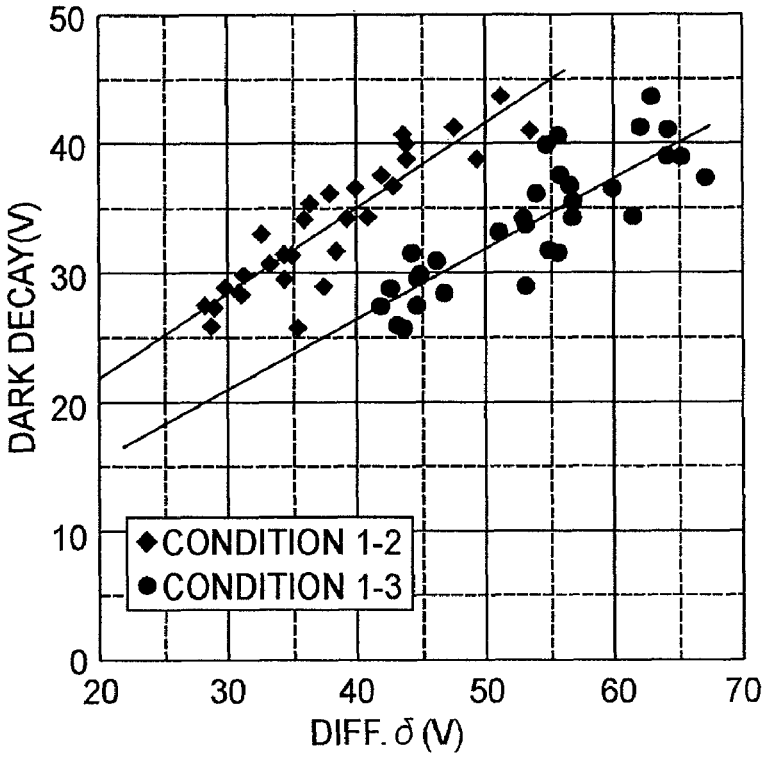
FIG. 4 is one of the graphs which show the relationship between the amount of dark attenuation and difference δ, and from which an example of an equation for estimating the amount of compensation for dark attenuation was derived.

FIG. 4 shows the relationship between the difference δ, obtained with an optional timing, and amount of dark attenuation of the photosensitive drum 10 employed by the image forming apparatus 100, in an operation in which 50,000 copies were continuously made.

The square dots plotted in FIG. 4 show the relationship between the amount of the dark attenuation of the photosensitive drum 10, and the difference δ between the surface potential level of the photosensitive drum 10 obtained under Condition 1 (first of operational conditions shown in Table 1) and that obtained under Condition 2 (second of operational conditions in Table 1), whereas the round dots plotted in FIG. 4 show the relationship between the amount of the dark attenuation of the photosensitive drum 10, and the difference δ between the potential level of the photosensitive drum 10 obtained under Condition 1 and that obtained under Condition 3. That is, the relationship shown by FIG. 4 is the relationship between the difference between the surface potential level of the photosensitive drum 10, which were measured at the position p3, that is, the position of the potential level sensor 17, and that measured at the position p4, that is, the position of the developing apparatus 16, and the amount of the dark attenuation of the photosensitive drum 10. In other words, FIG. 4 shows the amounts of the dark attenuation of the photosensitive drum 10 (the amount of surface potential attenuation of which is known), which were measured under the above-described various conditions. The square dots in FIG. 4 indicate that there is a roughly linear relationship between the difference δ between Conditions 1 and 2, and the amount of the dark attenuation of the photosensitive drum 10, whereas the round dots in FIG. 4 indicate that there is also a roughly linear relationship between the difference δ between Conditions 1 and 3, and the amount of the dark attenuation of the photosensitive drum 10. Incidentally, Table 1 also includes Condition 4, which is used in Example 2, which will be described later.

TABLE 1

| Condit'ns | Exp. before charging | Exp. before cleaning | Primary transfer voltage | Correcting formula |
|---|---|---|---|---|
| 1 (base) | ON | ON | ON | |
| 2 | OFF | ON | OFF | Y = 0.66x + 8.6 |
| 3 | OFF | OFF | OFF | Y = 0.55x + 4.6 |
| 4 | ON | ON | OFF | Y = 0.73x + 18 |

As the factors which affect the amount of the dark attenuation of the photosensitive drum 10, there have been known the condition of the operational environment, cumulative amount of the usage of the photosensitive drum 10, etc. It seems, however, that, in addition to the abovementioned factors, the amount of the light with which the peripheral surface of the photosensitive drum 10 is irradiated in the pre-irradiating process, that is, the process for removing electrical charge from the peripheral surface of the photosensitive drum 10 before charging the peripheral surface of the photosensitive drum 10, has a certain amount of effect upon the amount of the dark attenuation of the photosensitive drum 10. In other words, it is possible to think that under each of the various conditions under which the photosensitive drum 10 is pre-irradiated before it is charged, the changes in the condition under which the image forming apparatus 100 is operated, and the changes in the cumulative length of time of the usage of the image forming apparatus 100, is reflected upon the amount of the dark attenuation of the photosensitive drum 10, with its own ratio, and the overall amount of the dark attenuation of the photosensitive drum 10 can be estimated from the difference between them. That is, it may be thought that the amount of the carrier which is generated in the photosensitive layer by the pre-irradiation, the length of time it takes for the carrier to move from the photosensitive layer to the peripheral surface of the photosensitive drum 10, and reset the surface potential of the photosensitive drum 10, are affected by the environment in which the image forming apparatus 100 is operated, and the cumulative length of time the image forming apparatus 100 (photosensitive drum 10) has been operated. However, it may be said that they are likely to affect the amount of the dark attenuation of the photosensitive drum 10, with the roughly the same ratio as the amount of light with which the photosensitive drum 10 is pre-irradiated.

The most simplified description of the concept of the compensation for the dark attenuation of the photosensitive drum 10, which is in accordance with the present invention, is as follows: It is assumed here that if the pre-irradiation light is kept turned off, the surface potential of the photosensitive drum 10 hardly attenuates; the surface potential level of the photosensitive drum 10 which is measured at the position p1 (directly below charging device 11) when the pre-irradiation light is off, is the same as that when the peripheral surface of the photosensitive drum 10 is pre-irradiated by the same amount of light as that by which it is irradiated in an actual image forming operation. In this case, the effect of the carrier generated in the photosensitive layer, upon the attenuation of the surface potential of the photosensitive drum 10, is dependent upon the distance from the position p1, which is the location direction below the charging device 11, to the position p3, which is the position of the potential level sensor 17, and also, the distance from the position p1 (directly below charging device) to the position p4, which is the position of the developing apparatus 16. Thus, the amount of the dark attenuation of the photosensitive drum 10 can be estimated from the ratio among these factors.

Figure 3:
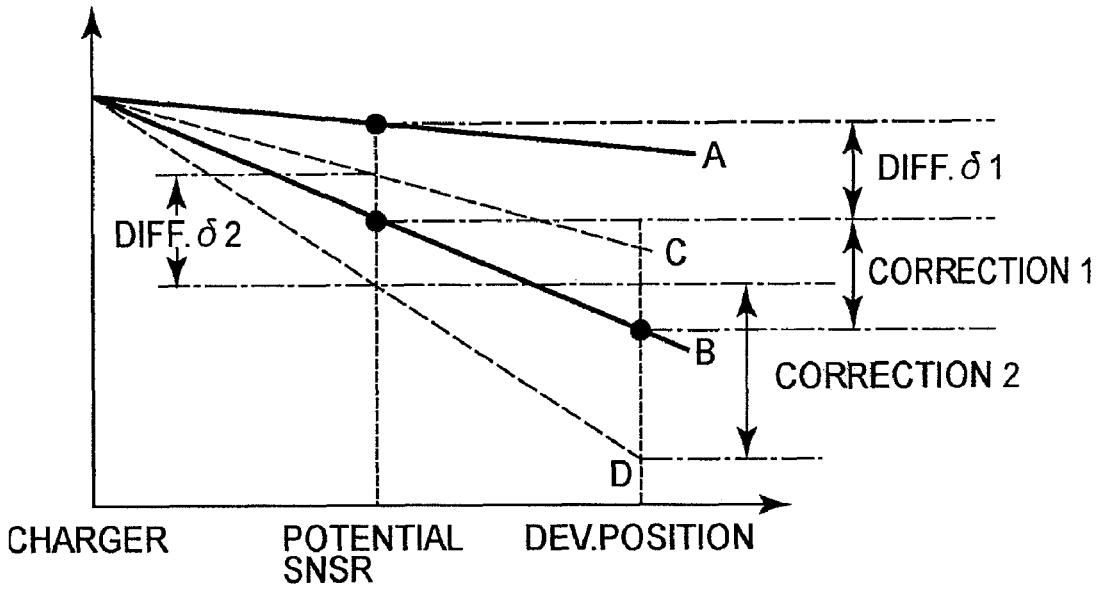
FIG. 3 is a schematic drawing which shows the concept of one of the methods, in accordance with the present invention, for compensating for dark attenuation.

FIG. 3 is a schematic drawing showing the commonly used method for compensating for the dark attenuation of the photosensitive drum 10. it is assumed, as described above, that the surface potential level of the photosensitive drum 10 measured at the position p1 (directly below charging device 11) when the pre-irradiation light is off, is the same as that when the peripheral surface of the photosensitive drum 10 is irradiated with the same amount of pre-irradiation light as that with which the peripheral surface of the photosensitive drum 10 is irradiated in an actual image forming operation. In this case, the characteristic of the photosensitive drum 10 in terms of the surface potential attenuation which occurs while a given point of the peripheral surface of the photosensitive drum 10 moves from the position p1 (directly below charging device 11) to the position p2 (developing apparatus position) when the pre-irradiation light is off, is represented by Line A in FIG. 3, and that after the peripheral surface of the photosensitive drum 10 is irradiated with the same amount of light as that with which it is irradiated in an actual image forming operation, is represented by Line B in FIG. 3. The characteristic of the photosensitive drum 10 represented in FIG. 3 by Line C is the characteristic of the photosensitive drum 10 after the characteristic of the photosensitive drum 10 represented by the Line A was affected by the change in the cumulative length of usage of the photosensitive drum 10, and the characteristic of the photosensitive drum 10 represented in FIG. 3 by Line D is the characteristic of the photosensitive drum 10 after the characteristic of 10 represented by the Line B was affected by the change in the cumulative length of usage of the photosensitive drum 10.

In order to make an adjustment by estimating the level at which the surface potential of the photosensitive drum 10 will be at the position p4 (developing apparatus position), from the surface potential level of the photosensitive drum 10 read (measured) by the potential level sensor 17, it is necessary to calculate the amount by which the potential of a given point of the peripheral surface of the photosensitive drum 10 will attenuate while it moves from the position p3 (potential level sensor location) to the position p4 (developing apparatus position) when the photosensitive drum 10 is used for the first time, and that after the photosensitive drum 10 is used for a certain length of time; in other words, the compensatory amounts 1 and 2, need to be calculated. For the calculation of these amounts, the linear approximation equation (dark attenuation amount calculation equation) derived from FIG. 4 can be used with both the differences δ1 and δ2, which were obtained under the various conditions before and after the usage of the photosensitive drum 10.

Incidentally, the surface potential level of the photosensitive drum 10 measured at the position p1 (directly below charging device 11), is affected by the state of deterioration of the charging device 11 itself. In this embodiment, however, the amount by which compensation is made is calculated based on the two differences δ1 and δ2 in the surface potential level of the photosensitive drum 10, which are obtained under two different conditions, one for one. Therefore, the amount by which compensation is made for the dark attenuation of the photosensitive drum 10, can be extracted (obtained) without being affected by the absolute values of the surface potential level of the photosensitive drum 10 measured at the position p1 (directly below charging device 11).

In some cases, if a given point of the peripheral surface of the photosensitive drum 10 is moved multiple times through the charging range with the pre-irradiation light turned off, the given point gradually increases in potential level; the given point does not remain constant in potential level. However, even if the number of times the given point is moved through the charging range is limited to one time, the characteristic of the photosensitive drum 10 in terms of chargeability can be reliably detected by comparing the potential levels of the photosensitive drum 10 measured before and after the photosensitive drum 10 is rotated one full turn.

In the above, this embodiment was described assuming that the potential level of the photosensitive drum 10 measured at the position p1 (directly below charging device) remains the same regardless of the change in the pre-irradiation condition. However, it is reasonable to think that even if the surface potential level of the peripheral surface 10 measured at the position p1 (immediately below charging device) changes because of the change in the pre-irradiation condition, the potential level of the photosensitive drum 10 is affected by the amount by which carrier is generated, environmental factors, cumulative length of usage of photosensitive drum 10, the like factors, in the same degree as described above. Therefore, it may be through that the relationship between the difference δ and the amount by which compensation is to be made will remain roughly the same.

Hereafter, the present invention will be described with reference to more concrete examples of this embodiment.

Example 1

In this example, the linear approximation equation derived in advance from FIG. 4, which shows the values obtained by the actual measurement of the surface potential level of the photosensitive drum 10, is used as the equation for calculating the amount by which compensation is made for dark attenuation, in the dark attenuation amount measurement mode, as the means for calculating the amount of the dark attenuation, the flowchart of which is FIG. 2.

Table 1 given above shows the equations for calculating the amount by which compensation has to be made for the dark attenuation of the photosensitive drum 10, under each of the comparative conditions (that is, conditions compared to Condition 1 to obtain difference δ).

The amount calculated with the use of the abovementioned equation for calculating the amount by which compensation is made for the amount of the dark attenuation of the photosensitive drum 10, is reflected upon the value of the grid high voltage, that is, one of the high voltages set for the charging device 11 to measure the potential level of the photosensitive drum 10 under Condition 1. That is, the thus obtained value is used as the value to which the grid voltage is to be set for an actual image forming operation.

In this example, Conditions 2 and 3, which are different from Condition 1 in one of the parameters (conditions) which affect the operation of the charge removing means, more specifically, the condition of the pre-irradiation light, are compared to Condition 1.

Figure 9:
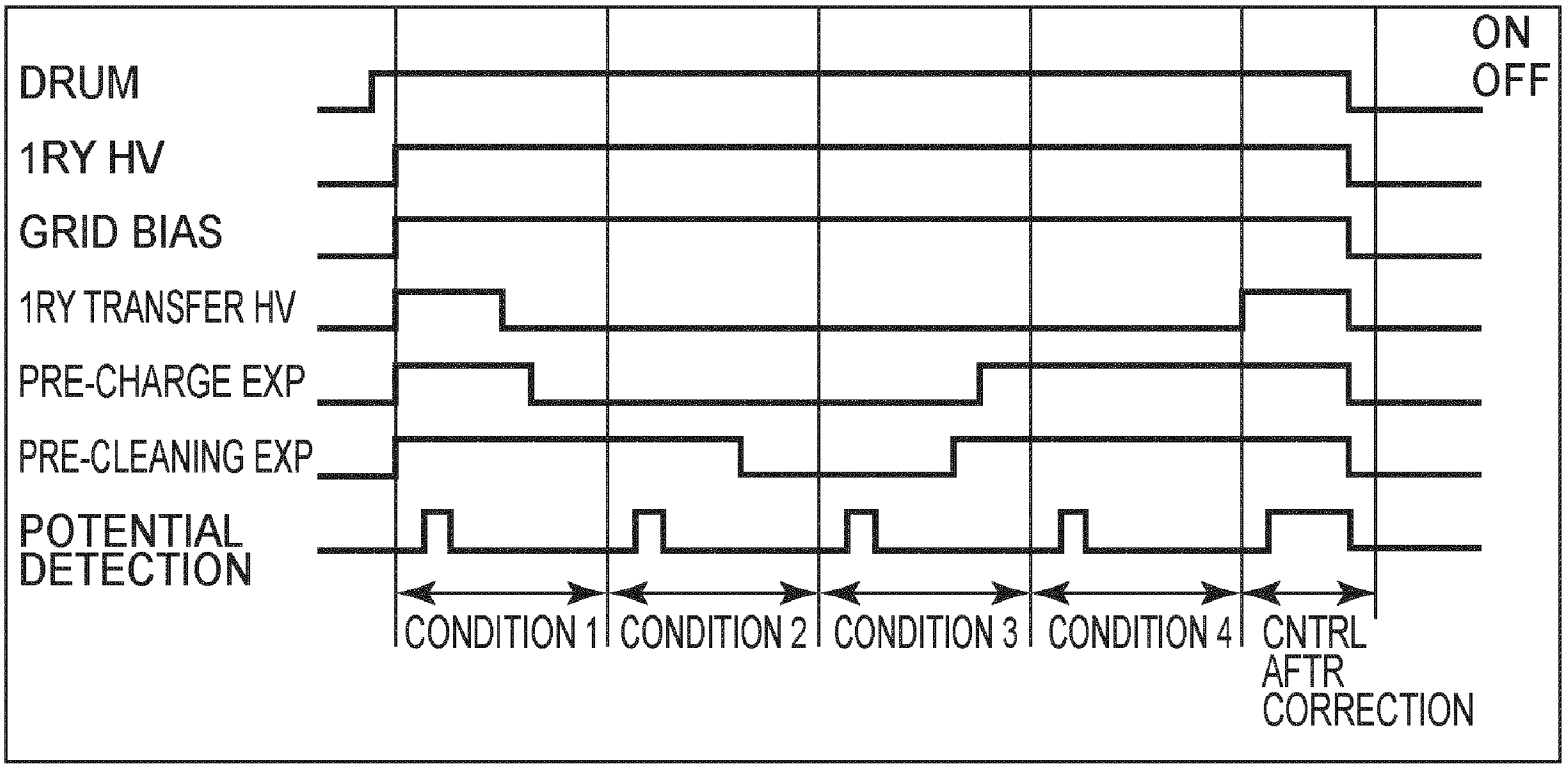
FIG. 9 is the timing chart for the dark attenuation measurement mode in accordance with the present invention.
Figure 10:
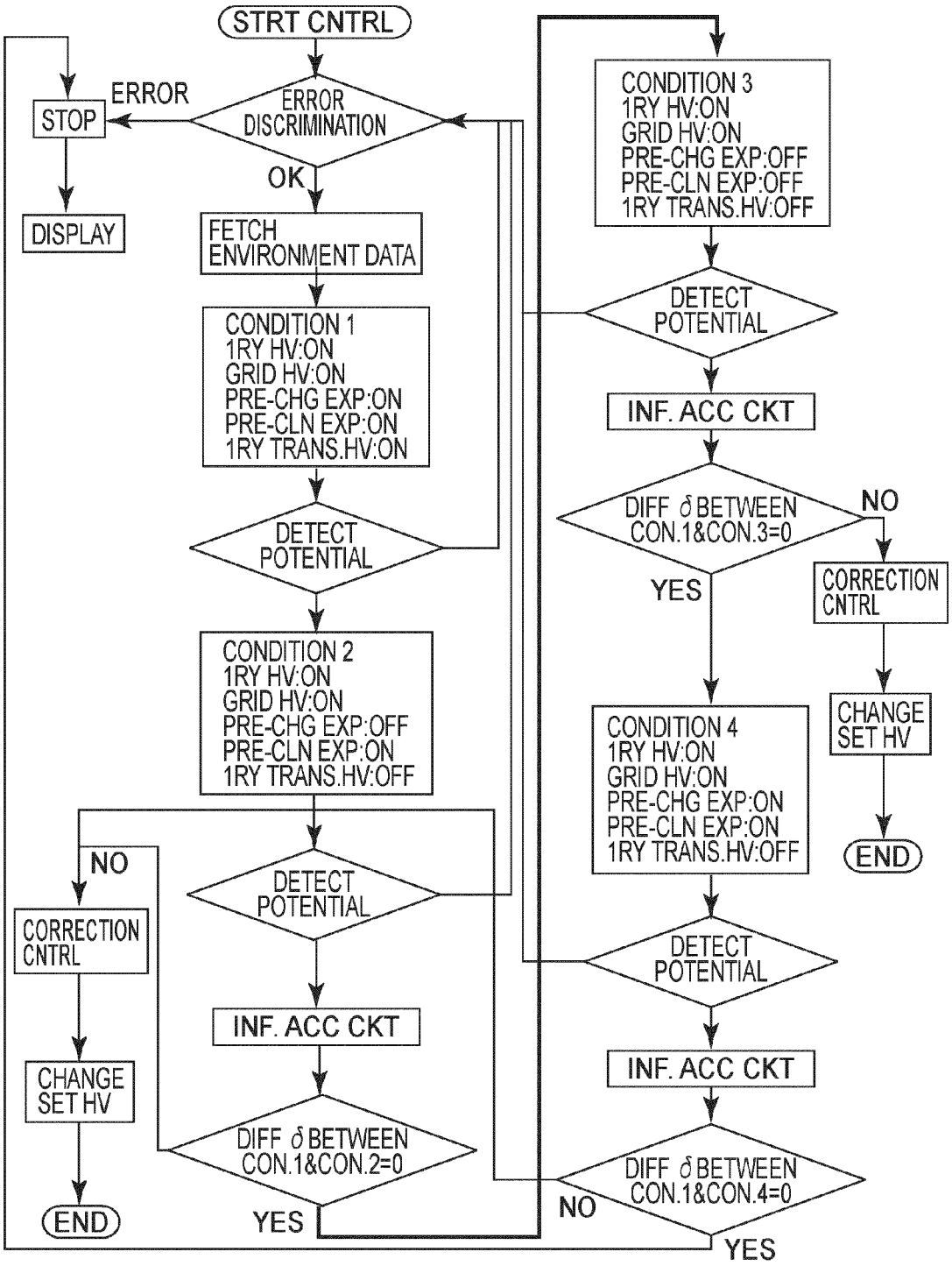
FIG. 10 is a flowchart for the dark attenuation measurement mode in accordance with the present invention.

Incidentally, the value to which the high voltage to be applied to the charging device 11 is to be set can be determined by extracting the values to which the dark potential level is to be set according to the condition of the environment in which the image forming apparatus is used, from the data stored in the internal storage portion of the information accumulation circuit 50. Compensation is made by carrying out an operation, such as the one shown by FIGS. 9 and 10, in the dark attenuation compensation mode, the flowchart of which is FIG. 2. More specifically, as soon as the control operation is started under Condition 1 shown in Table 1, the photosensitive drum 10 in the image forming apparatus begins to be rotated. After the elapse of a certain length of time preset for stabilization of the apparatus, for example, in term of torque, the primary high voltage, grid high voltage, and primary transfer high voltage are applied, and first and second pre-irradiation lights are turned on. In this example, the surface potential level of the photosensitive drum 10 is measured under Conditions 1, 2 and 3, with the grid high voltage Vg1 for the charging device 11 set to 800 V so that a total primary current of 1,000 μA flows.

Under Condition 1, the photosensitive drum 10 is charged with the high voltage for the charging device 11 set as described, and the primary transfer high voltage is set so that 35 μA of current flows as in an actual image forming operation. Further, the surface potential of the photosensitive drum 10 is removed by the first and second pre-irradiating device 12 and 14, which are set so that the amount of irradiation light on the peripheral surface of the photosensitive drum 10 is 30 μw. Then, the peripheral surface of the photosensitive drum 10 is charged once, and the surface potential level of the photosensitive drum 10 is measured by the potential level sensor 17. As for the timing of the measurement, first, the peripheral surface of the photosensitive drum 10 is charged to a preset potential level (dark potential level), and then, is moved through the primary transferring portion without being exposed. Then, the electrical charge is removed by the first pre-irradiating device, and is put through the charging process for the second time. Then, the surface potential level of the photosensitive drum 10 is measured by the potential level sensor 17. The output signal from the sensor 17 is stored as a signal A in an information storing apparatus. In a case where the signal A is not outputted (because potential level detecting means is broken, for example, it fails to measure surface potential level, or continuously outputs same signals for preset length of time), it is determined that an error (errors) has occurred. Then, the main assembly of the image forming apparatus 100 is stopped, and the process for dealing with the error (errors) is carried out.

After the signal A is outputted with no anomaly, the image forming apparatus 100 is operated under Condition 2. Under Condition 2, the photosensitive drum 10 is charged by the charging device 11, with its setting left the same as it is as under Condition 1, but, is not subjected to the primary transfer high voltage. Then, its electrical charge is removed only by the irradiation light from the second pre-irradiating device 14 (pre-cleaning irradiating device). Then, the photosensitive drum 10 is charged by the charging device 11 for the second time, and the surface potential level is measured by the potential level sensor 17. That is, Condition 2 is different from Condition 1 in the amount of the irradiation light from the pre-irradiating means. More specifically, in Condition 2, the first pre-irradiating device is not turned on, and the primary transfer high voltage is not applied. When a given portion of the peripheral surface of the photosensitive drum 10 is moved through the primary transferring portion after the signal A, which shows the potential level of the given point of the peripheral surface of the photosensitive drum 10, is outputted with no anomaly, the primary transfer high voltage is not applied. Further, when the given portion is moved through the second pre-irradiating portion, the first pre-irradiating device 12 is kept turned off. Thereafter, that is, after the photosensitive drum 10 is rotated once under Condition 2, the peripheral surface of the photosensitive drum 10 is subjected to the charging process for the second time. Then, the surface potential level of the photosensitive drum 10 is measured by the potential level sensor 17, which outputs a signal B at this time. The signal B is also stored in the information storing apparatus. Also in a case where the signal B is not outputted, the process for dealing with the error (errors) is carried out, which is similar to that carried out when the signal A is not outputted. After the signals A and B are obtained under Conditions 1 and 2, respectively, the two signals A and B are converted into digital signals, and the difference in value between the two signals A and B is extracted in the form of an absolute value. Then, this value is subjected to the verification process. More specifically, in this embodiment, it is checked whether or not $\delta=0$. If it is determined to be true, the amount of the dark attenuation of the photosensitive drum 10 is calculated with the use of the dark attenuation amount calculation equation, which is in the information storing apparatus, and then, the preset condition is adjusted according to the calculated amount of the dark attenuation. Then, the photosensitive drum 10 is charged with the high voltage set to the revised value, and the surface potential level of the photosensitive drum 10 is measured. If the thus obtained value of the surface potential level of the photosensitive drum 10 is normal, the control operation is ended, and then, the steps in the normal image forming operation are sequentially carried out. If the value of the abovementioned difference is determined to be false, the control operation is carried out under Condition 3.

Under Condition 3, the photosensitive drum 10 is charged by the charging device 11, with its setting left the same as it was under Condition 1, but, is not subjected to the primary transfer high voltage, and its electrical charge is not removed by the pre-irradiation. Then, the photosensitive drum 10 is charged by the charging device 11 for the second time, and its surface potential level is measured by the potential level sensor 17. That is, Condition 3 is different from Conditions 1 and 2 in the amount of the pre-irradiation light from the pre-irradiating means. More specifically, under Condition 3, when a given portion of the peripheral surface of the photosensitive drum 10 is moved through the first pre-irradiating portion after the signal B is outputted under the same condition as Condition 2, the second pre-irradiating device 14 is kept turned off. Thereafter, that is, after the photosensitive drum 10 is rotated once under Condition 3, the peripheral surface of the photosensitive drum 10 is subjected to the charging process for the second time. Then, the surface potential level of the photosensitive drum 10 is measured by the potential level sensor 17, which outputs a signal C at this time. The signal C is also stored in the information storing apparatus. Also in a case where the signal C is not outputted, the above-described process for dealing with the error (errors) is carried out. If the surface potential level of the photosensitive drum 10 is normal, after the signals A and C are obtained under Conditions 3 and 2, respectively, the two signals A and C are converted into digital signals, and the difference in value between the two signals A and B is extracted in the form of an absolute value. Then, this value is subjected to the verification process. More specifically, in this example, it is checked whether or not δ=0. If the absolute value of the difference is determined to be true, the amount of the dark attenuation of the photosensitive drum 10 is calculated with the use of the dark attenuation amount calculating equation, which is in the information storing apparatus, and then, the preset condition is adjusted according to the calculated amount of the dark attenuation. Then, the photosensitive drum 10 is charged with the high voltage set to the revised value, and the surface potential level of the photosensitive drum 10 is measured. If the thus obtained value of the surface potential level of the photosensitive drum 10 is normal, the control operation is ended, and then, the steps in the normal image forming operation are sequentially carried out. If the value of the difference is determined to be false, the control operation is carried out under Condition 4.

Under Condition 4, when a given portion of the peripheral surface of the photosensitive drum 10 is moved through the second pre-irradiating portion (pre-cleaning irradiating portion before cleaning device) after the potential level of the given portion is measured by the potential level detecting means under Condition 3, the second irradiating device 14 (pre-cleaning irradiating device) is kept turned on, and also, when the given portion is moved through the second pre-irradiating portion, the second pre-irradiating device 14 is kept turned on. Thereafter, that is, after the photosensitive drum 10 is rotated once under Condition 4, the peripheral surface of the photosensitive drum 10 is subjected to the charging process for the second time. Then, the surface potential level of the photosensitive drum 10 is measured by the potential level detecting means, which outputs a signal D at this time. The signal D is also stored in the information storing apparatus. Normally, after the signals A and D are obtained under the two different conditions, respectively, the two signals are converted into digital signals, and the difference in value between the two signals is extracted in the form of an absolute value. Then, this value is subjected to the verification process. More specifically, in this example, it is checked whether or not δ=0. If the value of the difference is determined to be true, the amount of the dark attenuation of the photosensitive drum 10 is calculated with the use of the dark attenuation amount calculating equation, which is in the information storing apparatus, and then, the preset condition is adjusted according to the calculated amount of the dark attenuation. Then, the photosensitive drum 10 is charged with the high voltage set to the revised value, and the surface potential level of the photosensitive drum 10 is measured. If the thus obtained value of the surface potential level of the photosensitive drum 10 is normal, the control operation is ended, and then, the steps in the normal image forming operation are sequentially carried out. If the value of the above-described difference is determined to be false, the main assembly of the image forming apparatus is stopped, and the process for dealing with the error is carried out.

The numerical values obtained by carrying out the above-described control operation is used by the image forming apparatus in this embodiment. In order to determine whether or not the present invention was effective, a means capable of measuring, from outside the apparatus, the surface potential level of the photosensitive drum 10 at the developing apparatus position, was installed to check whether or not the desired values were outputted at the developing portion when the image forming apparatus was controlled using the above described values. More specifically, as soon as the control operation was started, the information storing apparatus showed that the value of the initial signal A was −848 (V), and then, the value of the signal B was −810 (V) under Condition 2. This result indicated that the image forming apparatus moved from the controlling operation into the next step without the occurrence of errors, under both conditions (detection conditions). Thus, 38 (V) is obtained from the difference between the signals A and B, and the equation: δ=ABS(A−B). In this case, the control operation is ended after Condition 2, and therefore, the amount of the dark attenuation was obtained with the use of the dark attenuation amount calculation equation for Condition 1-2, which is the information storing apparatus, to obtain 34 V as the amount of the dark attenuation of the photosensitive drum 10. Based on this result, the initial value to which the high voltage was set was revised, and the control operation was carried out again, and the surface potential level of the photosensitive drum 10 was detected with the use of the external potential level sensor. The surface potential has been changed to the correct level from the level which was detected at the developing position under Condition 1. In other words, it was confirmed that the method, in accordance with the present invention, for compensating for dark attenuation was an effective means for dealing with the above-described problems.

As for the sampling of the output signals of the potential level sensor 17 under the various conditions, the average surface potential level obtained by charging the entirety of the peripheral surface of the photosensitive drum 10 is used as the surface potential level of the photosensitive drum 10.

It was confirmed that operating the image forming apparatus in the control mode (which is for measuring amount of dark attenuation of surface potential of photosensitive drum 10), in which the dark attenuation amount calculating equation in this embodiment was employed was effective to prevent fog formation.

The reflectivity (D1) of the background area of the sheet of recording paper used for an image forming operation, and the reflectivity (D2) of the unused sheet of recording paper cut from the same large sheet of recording paper as the large sheet of recording paper from which the sheet of recording paper used for the image forming operation, are measured at five points, and value of (D1−D2) was obtained at five points. Then, the average of the five values was used to evaluate fog density. The reflectivity was measured with the use of a TC-6D (product of Tokyo Denshoku Co., Ltd.).

Table 2, given below, shows the results of the comparison between the fog densities when the control in this embodiment was carried out (adjustment was made), and those when the control was not carried out (adjustment was not made). The amount of the ambient humidity, given in Table 2, is the absolute value of the amount of ambient moisture. Incidentally, Table 2 also shows the results of Example 2, which will be described later.

TABLE 2

| | Water content (absolute) | Fog density | |
|---|---|---|---|
| | (g/Kg Dry air) | non-correction | corrected |
| Ex. 1 | 0.86 | 2.6 | 2.2 |
| | 8.9 | 2.2 | 1.8 |
| | 21.6 | 1.9 | 1.5 |
| Ex. 2 | 0.86 | 2.7 | 2.2 |
| | 8.9 | 2.5 | 2.1 |
| | 21.6 | 2.2 | 1.9 |

It was confirmed from the results given in Table 2 that the control in this embodiment was effective to prevent fog formation.

Example 2

In the case of Example 1 described above, the information regarding the dark attenuation of the photosensitive drum 10 was obtained by measuring the surface potential level of the photosensitive drum 10 under various conditions, that is, the conditions different in terms of whether or not the light of the charging removing means is kept turned on. However, Example 1 is not intended to limit the present invention in terms of the conditions under which an image forming apparatus is to be operated in the control mode. In this example, or Example 2, Condition 4, which is different from Condition 1 in terms of transfer high voltage, which is one of the parameters in the operation of the charge removing means, is compared to Condition 1.

Figure 5:
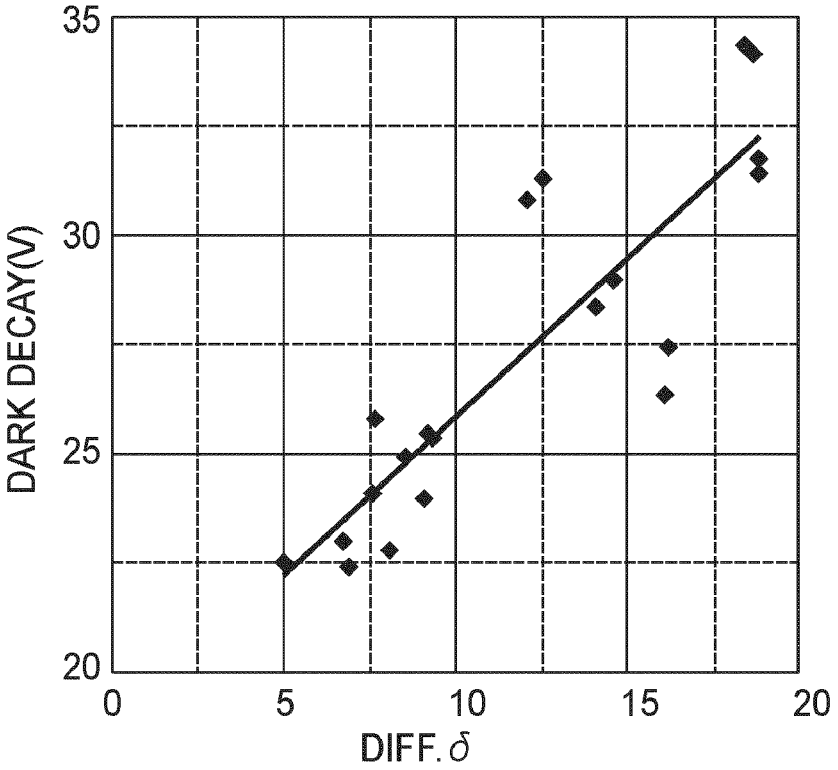
FIG. 5 is another of the graphs which show the relationship between the amount of dark attenuation and difference δ, and from which another example of an equation for estimating the amount of compensation for dark attenuation was derived.

FIG. 5 shows the relationship between the difference δ obtained with a proper timing, and the amount of the surface potential attenuation of the photosensitive drum 10, in an operation in which 50,000 copies were made with the use of the image forming apparatus 100. FIG. 5 shows the relationship between the difference δ obtained, in this example, when the control operation is carried out under Conditions 1 and 4, and the amount of the dark attenuation. That is, the relationship shown in FIG. 5 is the relationship between the difference between the surface potential level of the photosensitive drum 10 which is actually measured at the position p3 (potential level sensor position) and that which is actually measured at the position p4 (developing apparatus position), and the amount of the dark attenuation. That is, FIG. 5 shows the amounts of the dark attenuation, which were obtained by measuring, under various conditions, the amount of the dark attenuation of the photosensitive drum 10, the amount of dark attenuation of which was known in advance. The dots plotted in FIG. 5 (graph) indicate that there is an approximately linear relationship between the amount of the dark attenuation and the difference δ.

As the factors which affect the amount of the dark attenuation, environmental factors, cumulative length of the usage of the photosensitive drum 10, etc., can be listed. However, it is reasonable to think that the various conditions under which high voltage is applied in the transfer step before the charge removal step, and the charge removal step (carried out after transfer step), affect together the amount of the dark attenuation to some degrees. Therefore, the amount of change in environmental factors and the amount of change in the cumulative length of the usage of the photosensitive drum 10 are reflected upon the amount of the dark attenuation, at their own ratios, under various conditions under which high voltage is applied. Thus, it is reasonable to think that the overall amount of the dark attenuation can be estimated from the differences among the potential levels of the photosensitive drum 10, which are measured under the various conditions which are different in the amount of high voltages applied to the charge removing means. That is, it is reasonable to think that the length of time it takes to cause the surface potential level of the charged photosensitive drum 10 to reset, before the charging removing step, to a certain level, by applying transfer high voltage in the transfer step, that is, the step carried out immediately before the charge removal step is carried out, is affected by the changes in the environmental factors, and the cumulative length of the usage of the photosensitive drum 10. However, it may be said that they are likely to affect the amount of the dark attenuation at roughly the same ratio as that at which the transfer high voltage does.

Referring again to FIG. 3, which depicts the concept of compensating for the dark attenuation, in accordance with the present invention, as simply as possible, it is assumed, as described above, that the surface potential level of the photosensitive drum 10 at the position p1 (directly below charging device) when the transfer high voltage is not applied, is the same as that when a transfer high voltage is the same in value as the transfer high voltage applied in a normal image forming apparatus. In this case, the characteristic of the photosensitive drum 10, in terms of the dark attenuation which occurs as the given portion of the peripheral surface of the photosensitive drum 10 moves from the position p1 (directly below charging device) to the position p4 (developing apparatus position) when the transfer high voltage is not applied, and that when the transfer high voltage is applied, are represented by Lines A and B, respectively. Further, as the photosensitive drum 10, the characteristic of which are represented by Lines A and B, is affected by the change in the cumulative length of the usage of the photosensitive drum 10, it changes in the above-described characteristic. The characteristics of the photosensitive drum 10 after its change are represented by Lines C and D.

In order to make compensation for the dark attenuation by estimating the surface potential level of the photosensitive drum 10 at the position p4 (developing apparatus position), from the surface potential level of the photosensitive drum 10 read by the potential level sensor 17, the amount of the dark attenuation of a given portion of the photosensitive drum 10 which occurs while the given portion moves from the position p3 (potential level sensor location) to the position p4 (developing apparatus position), must be calculated when an image forming apparatus begins to be used, and after the image forming apparatus is used for a certain length of time. That is, the amounts 1 and 2, by which compensation is to be made, must be calculated. For this calculation, the linear approximation equation (equation for approximating amount of dark attenuation), which is derived from FIG. 5, may be used with both the differences δ1 and δ2 which are obtained before and after the image forming apparatus is used for a certain length of time.

In this example, the linear approximation equation derived in advance from FIG. 5 (graph) based on the amounts of the dark attenuation which were actually measured, was used as the equation for calculating the amount of compensation for the dark attenuation, in the control mode for measuring the amount of the dark attenuation, the flowchart of which is FIG. 2.

In Table 1 given above, equations for calculating the amount of compensation for the dark attenuation are provided for the comparative conditions used in this example, one for one.

Under Condition 1, the surface potential level of the photosensitive drum 10 is measured under the same condition as that in the first example (total primary current I1 is 1,000 a, and grid high voltage is 800 V).

Under condition 4, the primary transfer high voltage, which is applied under Condition 1, is not applied, and the charged peripheral surface of the photosensitive drum 10 is moved past the transfer position p5 while being kept in contact with the intermediary transfer belt 15*a*. Then, the peripheral surface of the photosensitive drum 10 is charged for the second time by the charging device 11, and then, the amount of its potential is measured by the potential level sensor 17.

That is, Condition 4 is different from Condition 1 in terms of the condition regarding the bias applied to the transferring means.

As for the sampling of the output signals of the potential level sensor 17 under the two conditions, the average surface potential level obtained by charging the entirety of the peripheral surface of the photosensitive drum 10 is used as the surface potential level of the photosensitive drum 10.

It was confirmed that operating the image forming apparatus in the control mode (which is for measuring amount of dark attenuation of photosensitive drum 10), in which the dark attenuation amount calculating equation in this embodiment was employed was effective to prevent fog formation. The measuring method and evaluating method were the same as those used in Example 1. The results of test are given in Table 2 as are the results of the test in Example 1.

It was possible to conform from the results shown in Table 2 that the control in this embodiment was effective for fog prevention.

As described above, in this embodiment, the amount of the dark attenuation of the photosensitive drum 10 was calculated from the difference in absolute value between the surface potential level of the photosensitive drum 10, which is measured with the charging removing means operated under one condition, and that under another condition, and the calculated amount of dark attenuation is reflected upon the surface potential control. Therefore, the photosensitive drum 10 can be highly precisely controlled in terms of surface potential level. Therefore, this embodiment can prevent fog formation.

That is, according to this embodiment, it is possible to compensate for the dark attenuation of the photosensitive drum 10 in order to more precisely control the conditions under which images are formed. Further, according to this embodiment, fog can be prevented by carrying out the control operation for compensating for the dark attenuation of the photosensitive drum 10. Further, according to this embodiment, the amount of the dark attenuation of the photosensitive drum 10 is not calculated by simply measuring the surface potential level of the peripheral surface of the photosensitive drum 10 twice, that is, before and after the photosensitive drum 10 is rotated one full turn. Therefore, the amount of the surface potential of the photosensitive drum 10 can be measured without being affected by the components which are in contact, or come into contact, with the photosensitive drum 10. Therefore, it can be more precisely measured.

In the above, the present invention was described with reference to more concrete example of this embodiment of the present invention. However, these examples are not intended to limit the present invention in scope.

Incidentally, the timing with which the dark attenuation amount measurement mode is started does not need to be limited to the above-described one. For example, the information accumulation circuit 50 of the image forming apparatus 100 may be provided with an internal timer so that the dark attenuation amount measurement mode is started with preset intervals. Further, the dark attenuation amount measurement mode may be started for every preset number of prints. These timings may be better from the standpoint of compensating for the deterioration of the photosensitive drum 10.

Further, the area of the peripheral surface of the photosensitive drum 10, which is to be charged to determine the surface potential level of the photosensitive drum 10, does not need to be limited to the above-described area. That is, the surface potential level of the photosensitive drum 10 may be determined by locally charging the peripheral surface of the photosensitive drum 10 and measuring the surface potential level of the charged area. However, in consideration of the characteristic of the photosensitive drum 10 (peripheral surface of photosensitive drum 10 may not be uniform in potential level), it may be said that the above-described surface potential level measuring method in this embodiment is better.

Further, the photosensitive drum 10 may be increased in rotational speed for the dark attenuation amount measurement mode. The revolution of the photosensitive drum 10 does not need to be limited to that in this embodiment. That is, the photosensitive drum 10 may be rotated faster than the speed at which it is rotated in this embodiment, within a range in which the characteristic of the photosensitive drum 10 in terms of dark attenuation remains linear.

Further, in this embodiment described above, control was carried out using the equation for calculating the amount of compensation for dark attenuation, which was derived based on the amount of the dark attenuation after the photosensitive drum 10 was used to yield a certain number of copies. However, some photosensitive drums accelerate in the rate at which they deteriorate in terms of chargeability, as they increase in the cumulative length of usage. In the case of these photosensitive drums, the relationship between the amount of the dark attenuation and difference $\delta$ may not agree with the amount calculated with the use of the dark attenuation amount calculating equation, which is derived based on the amount of the dark attenuation after the photosensitive drum 10 was used to yield a certain number of copies. Therefore, the equation for calculating the amount of compensation for dark attenuation may be modified according to the information regarding the history of the usage of photosensitive drum 10, for example, the cumulative number of copies made, cumulative revolution of the photosensitive drum 10, cumulative length of charging time, etc. More concretely, the equation for calculating the amount of compensation for dark attenuation may be modified so that the longer the image forming apparatus 100 is in the cumulative amount of usage, which can be indexed by the cumulative revolution of the photosensitive drum 10, cumulative length of charging time, etc., the greater the amount of dark attenuation calculated by the equation. The amount of compensation may be determined in advance by experiments or the like, and can be stored. Further, two or more equations for calculating the amount of compensation for dark attenuation may be created and stored in advance according to the differences in history of usage of the photosensitive drum 10, so that a proper one can selected according to the cumulative amount of the usage of the photosensitive drum 10. Sometimes, the employment of this approach can provide an idealistic method for controlling the surface potential of the photosensitive drum 10. That is, the image formation condition can be changed based on the surface potential level of the photosensitive drum 10 detected by the potential level sensor 17, under the various conditions under which the above described charge removing means is operated, and the information regarding the history of the image forming apparatus.

Further, in the case of an image forming apparatus which has multiple development positions, in terms of the moving direction of the peripheral surface of the photosensitive drum 10, multiple equations for calculating the amount of compensation for dark attenuation may be provided for the multiple developing positions, one for one, or compensation may be made for each development position.

Further, in this embodiment described above, the photosensitive drum 10 is exposed with the use of a beam of laser light, and toner was adhered by the developing apparatus to the numerous exposed points of the peripheral surface of the photosensitive drum 10. That is, the image formed on the peripheral surface of the photosensitive drum 10 was developed in reverse. However, the present invention is also applicable to an image forming apparatus which adheres toner to the numerous unexposed points of the peripheral surface of the photosensitive drum 10. That is, the present invention is also applicable to an image forming apparatus which normally develops a latent image on the peripheral surface of its photosensitive drum, with the use of its developing apparatus. The effects of such an application are the same as those obtained by the image forming apparatus in this embodiment.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 027412/2007 filed Feb. 6, 2007, which is hereby incorporated by reference.

What is claimed is:

1. An image forming apparatus comprising:

a photosensitive member having a movable surface;

a charging device configured to charge said photosensitive member;

an image exposure device configured to expose the surface of said photosensitive member charged by said charging device to light in accordance with image information, thus forming an electrostatic image;

a developing device configured to develop the electrostatic image formed on said photosensitive member into a developed image;

a potential detecting device configured to detect a potential of the surface of said photosensitive member;

a discharging device configured to discharge said photosensitive member by exposing said photosensitive member to light, said discharging device being disposed downstream of a transfer position where the developed image is transferred onto an image receiving material and upstream of a charging position where said charging device charges said image photosensitive member, with respect to a moving direction of the surface of said photosensitive member; and a changing device configured to change an image forming condition, wherein an area of said photosensitive member passes said discharging device under different operating conditions of said discharging device, and the area is charged by said charging device, said changing device changes the image forming condition on the basis of a result of detection, by said potential detecting device, of surface potentials of the area charged by said charging device.

2. An apparatus according to claim 1, wherein dark decay of said photosensitive member is calculated on the basis of the surface potentials detected by said detecting device with the different operating conditions of said discharging device, and the image forming condition is changed on the basis of the calculated dark decay.

3. An apparatus according to claim 2, wherein the dark decay is calculated on the basis of the difference between the surface potentials detected by said potential detecting device with the different operating conditions of said discharging device.

4. An apparatus according to claim 3, wherein the dark decay on the basis of the difference and an amount of the dark decay occurring from a detecting position of said potential detecting device to a developing position of said developing device along a predetermined moving direction of the surface of said photosensitive member.

5. An apparatus according to claim 1, wherein said changing device changes the image forming condition on the basis of the surface potential of the photosensitive member detected by said potential detecting device with the different operating conditions of said discharging device and use history information of said image forming apparatus.

6. An apparatus according to claim 1, wherein the image forming condition includes a set point of a potential control of said photosensitive member.

7. An apparatus according to claim 6, wherein the set point of the potential control is a set point of a bias voltage applied to said charging device.

8. An apparatus according to claim 1, wherein the image forming condition includes a set point of a bias voltage applied to said developing device.

9. An apparatus according to claim 1, wherein the different operating conditions is provided by rendering a discharging operation of said discharging device off.

* * * * *